US007715940B2

(12) United States Patent
Muto et al.

(10) Patent No.: US 7,715,940 B2
(45) Date of Patent: May 11, 2010

(54) EMBROIDERY DATA PROCESSING DEVICE AND COMPUTER PROGRAM PRODUCT

(75) Inventors: Yukiyoshi Muto, Nagoya (JP); Mikitoshi Suzuki, Nagoya (JP); Masahiro Mizuno, Nagoya (JP); Shoichi Taguchi, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 988 days.

(21) Appl. No.: 11/475,199

(22) Filed: Jun. 27, 2006

(65) Prior Publication Data

US 2007/0014436 A1 Jan. 18, 2007

(30) Foreign Application Priority Data

Jul. 12, 2005 (JP) ..... 2005-203391

(51) Int. Cl.
*D05C 5/02* (2006.01)

(52) U.S. Cl. ..... 700/138; 112/470.01; 112/475.19

(58) Field of Classification Search ..... 700/136–138; 112/470.01, 470.06, 470.09, 475.19
See application file for complete search history.

(56) References Cited

U.S. PATENT DOCUMENTS 5,191,536 A * 3/1993 Komuro et al. ..... 700/138
6,510,360 B1 * 1/2003 Kaymer et al. ..... 700/138

FOREIGN PATENT DOCUMENTS

| | | | |
|---|---|---|---|
| JP | A-08-038756 | | 2/1996 |
| JP | 09316768 | A * | 12/1997 |
| JP | 11137872 | A * | 5/1999 |
| JP | 2000342868 | A * | 12/2000 |

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

The disclosure presents an embroidery data processing device and a computer program product capable of creating a single unit of tree structure vector data by coupling plural pieces of independent tree structure vector data. A coupling node is added between nodes and of a tree structure vector data, and a vector data to for coupling nodes and, and a vector data to for coupling nodes and are created, and thereby a tree structure vector data is created. In a tree structure vector data, the node mutual direction is converted so that the node existing at the connecting position may be a root node, and a tree structure vector data is created, and this root node is coupled with the coupling node of the tree structure vector data, and a single tree structure vector data is created.

20 Claims, 25 Drawing Sheets

FIG. 5

33

| SEWING SEQUENCE | SEWING START NODE | SEWING END NODE | SEWING MANNER |
|---|---|---|---|
| 1 | N3 | N2 | Zigzag |
| 2 | N2 | N5 | Running |
| 3 | N5 | N6 | Running |
| 4 | N6 | N7 | Running |
| 5 | N7 | N6 | Zigzag |
| 6 | N6 | N8 | Running |
| 7 | N8 | N6 | Zigzag |
| 8 | N6 | N5 | Zigzag |
| 9 | N5 | N9 | Running |
| 10 | N9 | N10 | Running |
| 11 | N10 | N11 | Running |
| 12 | N11 | N10 | Zigzag |
| 13 | N10 | N12 | Running |
| 14 | N12 | N10 | Zigzag |
| 15 | N10 | N9 | Zigzag |
| 16 | N9 | N13 | Running |
| 17 | N13 | N14 | Running |
| 18 | N14 | N15 | Running |
| 19 | N15 | N14 | Zigzag |
| 20 | N14 | N16 | Running |
| 21 | N16 | N14 | Zigzag |
| 22 | N14 | N13 | Zigzag |
| 23 | N13 | N17 | Running |
| 24 | N17 | N13 | Zigzag |
| 25 | N13 | N9 | Zigzag |
| 26 | N9 | N5 | Zigzag |
| 27 | N5 | N2 | Zigzag |
| 28 | N2 | N4 | Running |
| 29 | N4 | N2 | Zigzag |
| 30 | N2 | N1 | Zigzag |

FIG. 13

49

| SEWING SEQUENCE | SEWING START NODE | SEWING END NODE | SEWING MANNER |
|---|---|---|---|
| 1 | N3 | N2 | Zigzag |
| 2 | N2 | N22 | Running |
| 3 | N22 | N21 | Running |
| 4 | N21 | N20 | Running |
| 5 | N20 | N21 | Zigzag |
| 6 | N21 | N23 | Running |
| 7 | N23 | N21 | Zigzag |
| 8 | N21 | N22 | Zigzag |
| 9 | N22 | N5 | Running |
| 10 | N5 | N6 | Running |
| 11 | N6 | N7 | Running |
| 12 | N7 | N6 | Zigzag |
| 13 | N6 | N8 | Running |
| 14 | N8 | N6 | Zigzag |
| 15 | N6 | N5 | Zigzag |
| 16 | N5 | N9 | Running |
| 17 | N9 | N10 | Running |
| 18 | N10 | N11 | Running |
| 19 | N11 | N10 | Zigzag |
| 20 | N10 | N12 | Running |
| 21 | N12 | N10 | Zigzag |
| 22 | N10 | N9 | Zigzag |
| 23 | N9 | N13 | Running |
| 24 | N13 | N14 | Running |
| 25 | N14 | N15 | Running |
| 26 | N15 | N14 | Zigzag |
| 27 | N14 | N16 | Running |
| 28 | N16 | N14 | Zigzag |
| 29 | N14 | N13 | Zigzag |
| 30 | N13 | N17 | Running |
| 31 | N17 | N13 | Zigzag |
| 32 | N13 | N9 | Zigzag |
| 33 | N9 | N5 | Zigzag |
| 34 | N5 | N22 | Zigzag |
| 35 | N22 | N2 | Zigzag |
| 36 | N2 | N4 | Running |
| 37 | N4 | N2 | Zigzag |
| 38 | N2 | N1 | Zigzag |

FIG. 20

62

| SEWING SEQUENCE | SEWING START NODE | SEWING END NODE | SEWING MANNER |
|---|---|---|---|
| 1 | N3 | N2 | Zigzag |
| 2 | N2 | N32 | Running |
| 3 | N32 | N30 | Running |
| 4 | N30 | N32 | Zigzag |
| 5 | N32 | N31 | Running |
| 6 | N31 | N32 | Zigzag |
| 7 | N32 | N5 | Running |
| 8 | N5 | N6 | Running |
| 9 | N6 | N7 | Running |
| 10 | N7 | N6 | Zigzag |
| 11 | N6 | N8 | Running |
| 12 | N8 | N6 | Zigzag |
| 13 | N6 | N5 | Zigzag |
| 14 | N5 | N9 | Running |
| 15 | N9 | N10 | Running |
| 16 | N10 | N11 | Running |
| 17 | N11 | N10 | Zigzag |
| 18 | N10 | N12 | Running |
| 19 | N12 | N10 | Zigzag |
| 20 | N10 | N9 | Zigzag |
| 21 | N9 | N13 | Running |
| 22 | N13 | N14 | Running |
| 23 | N14 | N15 | Running |
| 24 | N15 | N14 | Zigzag |
| 25 | N14 | N16 | Running |
| 26 | N16 | N14 | Zigzag |
| 27 | N14 | N13 | Zigzag |
| 28 | N13 | N17 | Running |
| 29 | N17 | N13 | Zigzag |
| 30 | N13 | N9 | Zigzag |
| 31 | N9 | N5 | Zigzag |
| 32 | N5 | N32 | Zigzag |
| 33 | N32 | N2 | Zigzag |
| 34 | N2 | N4 | Running |
| 35 | N4 | N2 | Zigzag |
| 36 | N2 | N1 | Zigzag |

FIG. 26

81

| SEWING SEQUENCE | SEWING START NODE | SEWING END NODE | SEWING MANNER |
|---|---|---|---|
| 1 | N3 | N2 | Zigzag |
| 2 | N2 | N5 | Running |
| 3 | N5 | N9 | Running |
| 4 | N9 | N10 | Running |
| 5 | N10 | N11 | Running |
| 6 | N11 | N10 | Zigzag |
| 7 | N10 | N12 | Running |
| 8 | N12 | N10 | Zigzag |
| 9 | N10 | N9 | Zigzag |
| 10 | N9 | N13 | Running |
| 11 | N13 | N14 | Running |
| 12 | N14 | N15 | Running |
| 13 | N15 | N14 | Zigzag |
| 14 | N14 | N16 | Running |
| 15 | N16 | N14 | Zigzag |
| 16 | N14 | N13 | Zigzag |
| 17 | N13 | N17 | Running |
| 18 | N17 | N13 | Zigzag |
| 19 | N13 | N9 | Zigzag |
| 20 | N9 | N5 | Zigzag |
| 21 | N5 | N2 | Zigzag |
| 22 | N2 | N4 | Running |
| 23 | N4 | N2 | Zigzag |
| 24 | N2 | N1 | Zigzag |

FIG. 27

82

| SEWING SEQUENCE | SEWING START NODE | SEWING END NODE | SEWING MANNER |
|---|---|---|---|
| 1 | N5 | N6 | Running |
| 2 | N6 | N7 | Running |
| 3 | N7 | N6 | Zigzag |
| 4 | N6 | N8 | Running |
| 5 | N8 | N6 | Zigzag |
| 6 | N6 | N5 | Zigzag |

EMBROIDERY DATA PROCESSING DEVICE AND COMPUTER PROGRAM PRODUCT

CROSS-REFERENCE TO RELATED APPLICATIONS

This application claims priority from JP 2005-203391, filed Jul. 12, 2005, the contents of which are hereby incorporated by reference.

TECHNICAL FIELD

The disclosure relates to an embroidery data processing device and a computer program product, and more particularly to an embroidery data processing device and a computer program product capable of creating embroidery data of consecutive sewing sequence without jumping by coupling plural pieces of independent tree structure vector data to a single unit of tree structure vector data. It also relates to an embroidery data processing device and a computer program product capable of dividing a single unit of tree structure vector data into arbitrary plural pieces of the tree structure vector data, and creating independent embroidery data of sewing sequence.

BACKGROUND

Hitherto, various ideas have been proposed about embroidery data processing device and computer program product for creating tree structure vector data by coupling nodes mutually from a root node to an end node by vector data on the basis of drawing information composing an embroidery pattern, and creating embroidery data of consecutive sewing sequence on the basis of the tree structure vector data.

For example, a proposed embroidery data processing device for creating necessary embroidery data for sewing an embroidery pattern composed of a line drawing by a sewing machine comprises reading device for reading image data from an original drawing of the embroidery pattern, tree structure vector data creating device for creating tree structure vector data in a format having branch points mutually coupled by vector data on the basis of the image data read out by reading device, searching device for making depth priority search on the tree structure vector data created by tree structure vector data creating device, and searching the vector data in two directions of forward direction and backward direction starting from the corresponding point on the embroidery pattern, and sewing data creating device for creating underlying stitch sewing data on the basis of forward searched vector data by searching device, and creating embroidery stitch sewing data overlaid on the underlying stitch sewing data on the basis of backward searched vector data (see, for example, Japanese patent application laid-open No. H8 (1996)-38756 paragraphs [0010] to [0036], and FIGS. 1 to 10).

Such conventional embroidery data processing device, however, can create embroidery data without jumping within one tree structure vector data, but when adding other tree structure vector data to an existing tree structure vector data, consecutive sewing sequence cannot be created by coupling the sewing sequence on the basis of the one tree structure vector data and the sewing sequence on the basis of the other tree structure vector data, and useless jump stitch occurs between root nodes, and removing job of jump stitch is complicated. Or when one existing tree structure vector data is divided into plural pieces of the tree structure vector data, it is not possible to sew by threads of different colors by creating embroidery data in a plurality of independent sewing sequences.

SUMMARY

The disclosure is devised to solve the problems mentioned above, and it is hence an object thereof to present an embroidery data processing device and a computer program product capable of creating a consecutive sewing sequence coupling the sewing sequence on the basis of one tree structure vector data and the sewing sequence on the basis of other tree structure vector data, when adding other tree structure vector data to the existing tree structure vector data. It also presents an embroidery data processing device and a computer program product capable of creating embroidery data of a plurality of independent sewing sequences by dividing a single unit of existing tree structure vector data into plural pieces of the tree structure vector data.

To achieve the purpose above, there is provided an embroidery data processing device comprising: a tree structure vector data creating device that creates tree structure vector data by coupling nodes mutually from a root node to an end node by vector data on the basis of drawing information composing an embroidery pattern; and an embroidery data creating device that creates running stitch sewing data on the basis of the vector data from the root node to the end node for the tree structure vector data, and creating embroidery stitch sewing data overlaid on the running stitch sewing data on the basis of the vector data from the end node to the root node, wherein the tree structure vector data creating device includes: a coupled tree structure vector data creating device that creates a single unit of tree structure vector data by coupling independent second tree structure vector data to first tree structure vector data.

In this embroidery data processing device, the tree structure vector data is created by coupling nodes mutually from the root node to the end node by vector data on the basis of drawing information composing an embroidery pattern. First tree structure vector data is coupled with second tree structure vector data independent of the first tree structure vector data, and a single unit of a tree structure vector data is created. In this tree structure vector data, running stitch sewing data is created on the basis of the vector data from the root node to the end node, and embroidery stitch sewing data overlaid on the running stitch sewing data is created on the basis of the vector data from the end node to the root node.

As a result, the first tree structure vector data is coupled with the second tree structure vector data independent of the first tree structure vector data, and a single unit of tree structure vector data is created, and on the basis of this single unit of the tree structure vector data, consecutive sewing data in desired sewing sequence can be created. Hence, when desired to add other second tree structure vector data to the existing first tree structure vector data, the user can create a desired consecutive sewing sequence by coupling the sewing sequence on the basis of the first tree structure vector data and the sewing sequence on the basis of the second tree structure vector data, and a beautiful embroidery pattern can be formed in high quality not causing useless jump stitch in the finished state.

To achieve the above object, there is also provided an embroidery data processing device comprising: a tree structure vector data creating device that creates tree structure vector data by coupling nodes mutually from a root node to an end node by vector data on the basis of drawing information composing an embroidery pattern; the embroidery data creating device that creates running stitch sewing data on the basis of the vector data from the root node to the end node for the tree structure vector data, and creating embroidery stitch sewing data overlaid on the running stitch sewing data on the basis of the vector data from the end node to the root node; a dividing position input device that inputs a dividing position for dividing the tree structure vector data into plural pieces of partial tree structure vector data; and a tree structure vector data dividing device that divides the tree structure vector data into the plural pieces of the partial tree structure vector data on the basis of the dividing position input by the dividing position input device.

In this embroidery data processing device, on the basis of drawing information composing the embroidery pattern, the tree structure vector data is created by coupling nodes mutually from the root node to the end node by the vector data. The user inputs, by dividing position input device, the dividing position for dividing the tree structure vector data into plural pieces of partial tree structure vector data, and the tree structure vector data is divided into plural pieces of the partial tree structure vector data on the basis of the input dividing position. In the partial tree structure vector data, the running stitch sewing data is created on the basis of the vector data from the root node to the end node, and the embroidery stitch sewing data overlaid on the running stitch sewing data is created on the basis of the vector data from the end node to the root node.

Accordingly, on the basis of the dividing position input by the user through dividing position input device, the tree structure vector data can be divided into plural pieces of the partial tree structure vector data, and on the basis of the plural pieces of the divided partial tree structure vector data, a sewing data of independent consecutive sewing sequences can be created, and it is possible to sew by threads of desired colors according to the plural pieces of the divided partial tree structure vector data.

To achieve the above object, there is also provided a computer program product used and executed in an embroidery data processing device comprising: a computer readable recording medium; and a computer program stored in the computer readable recording medium, wherein the computer program includes: a tree structure vector data creating step of creating tree structure vector data by coupling nodes mutually from a root node to an end node by vector data on the basis of drawing information composing an embroidery pattern; and an embroidery data creating step of creating running stitch sewing data on the basis of the vector data from the root node to the end node for the tree structure vector data, and creating the embroidery stitch sewing data overlaid on the running stitch sewing data on the basis of the vector data from the end node to the root node, and the tree structure vector data creating step includes: a coupled tree structure vector data creating step of creating a single unit of tree structure vector data by coupling independent second tree structure vector data to first tree structure vector data.

In the computer program product, the computer reads a program stored in the recording medium, and creates tree structure vector data having the nodes coupled mutually from the root node to the end node by the vector data on the basis of drawing information composing the embroidery pattern. Further, the single unit of tree structure vector data is created by the coupling of the second independent tree structure vector data and the first tree structure vector data. From the tree structure vector data, the running stitch sewing data is created on the basis of the vector data from the root node to the end node, and the embroidery stitch sewing data overlaid on the running stitch sewing data is created on the basis of the vector data from the end node to the root node.

The computer creates the single tree structure vector data by coupling the first tree structure vector data and the independent second tree structure vector data, and further creates the sewing data in consecutive sewing sequence on the basis of this single tree structure vector data. When the user desires to add other second tree structure vector data to the existing first tree structure vector data, consecutive sewing sequence can be formed by the coupling of the sewing sequence on the basis of the first tree structure vector data and the sewing sequence on the basis of second tree structure vector data, and a beautiful embroidery pattern can be formed in high quality not causing useless jump stitch in the finished state.

To achieve the above object, there is also provided a computer program product used and executed in an embroidery data processing device comprising: a computer readable recording medium; and a computer program stored in the computer readable recording medium, wherein the computer program includes: a tree structure vector data creating step of creating tree structure vector data by coupling nodes mutually from a root node to an end node by vector data on the basis of drawing information composing an embroidery pattern; an embroidery data creating step of creating running stitch sewing data on the basis of the vector data from the root node to the end node for the tree structure vector data, and creating embroidery stitch sewing data overlaid on the running stitch sewing data on the basis of the vector data from the end node to the root node; a dividing position input step of inputting a dividing position for dividing the tree structure vector data into a plural pieces of partial tree structure vector data; and a tree structure vector data dividing step of dividing the tree structure vector data into the plural pieces of the partial tree structure vector data on the basis of the dividing position input at the dividing position input step.

In the computer program product, the computer reads a program stored in the recording medium, and creates the tree structure vector data having the nodes coupled mutually from the root node to the end node by the vector data on the basis of drawing information composing the embroidery pattern. The user inputs, at a dividing position input step, the dividing position for dividing the tree structure vector data into the plural pieces of partial tree structure vector data. The computer divides the tree structure vector data into the plural pieces of the partial tree structure vector data on the basis of the input dividing position. The computer, in the partial tree structure vector data, creates the running stitch sewing data on the basis of the vector data from the root node to the end node, and creates the embroidery stitch sewing data overlaid on the running stitch sewing data on the basis of the vector data from the end node to the root node.

Accordingly, the computer, on the basis of the dividing position input at the dividing position input step, divides the tree structure vector data into the plural pieces of the partial tree structure vector data, and on the basis of the plural pieces of the divided partial tree structure vector data, creates the sewing data of the independent continuous sewing sequences, and it is hence possible to sew by threads of desired colors according to the plural pieces of the divided partial tree structure vector data.

BRIEF DESCRIPTION OF THE DRAWINGS

FIG. 5 is a diagram of an example of the embroidery data created from the tree structure vector data shown in FIG. 4;

FIG. 13 is a diagram of an example of the embroidery data created on the basis of the tree structure vector data in FIG. 12;

FIG. 20 is a diagram of an example of the embroidery data created on the basis of the tree structure vector data in FIG. 19;

FIG. 26 is a diagram of an example of the embroidery data created on the basis of the partial tree structure vector data having the root node before division in FIG. 25;

FIG. 27 is a diagram of an example of the embroidery data created on the basis of the partial tree structure vector data converting the divided node into the root node in FIG. 25;

DETAILED DESCRIPTION

The embroidery data processing device and computer program product of the disclosure are described specifically below with reference to drawings on the basis of exemplary embodiment 1 and exemplary embodiment 2 of the disclosure.

Exemplary Embodiment 1

An outline of the embroidery data processing device in exemplary embodiment 1 is explained with reference to FIG. 1.

Figure 1:
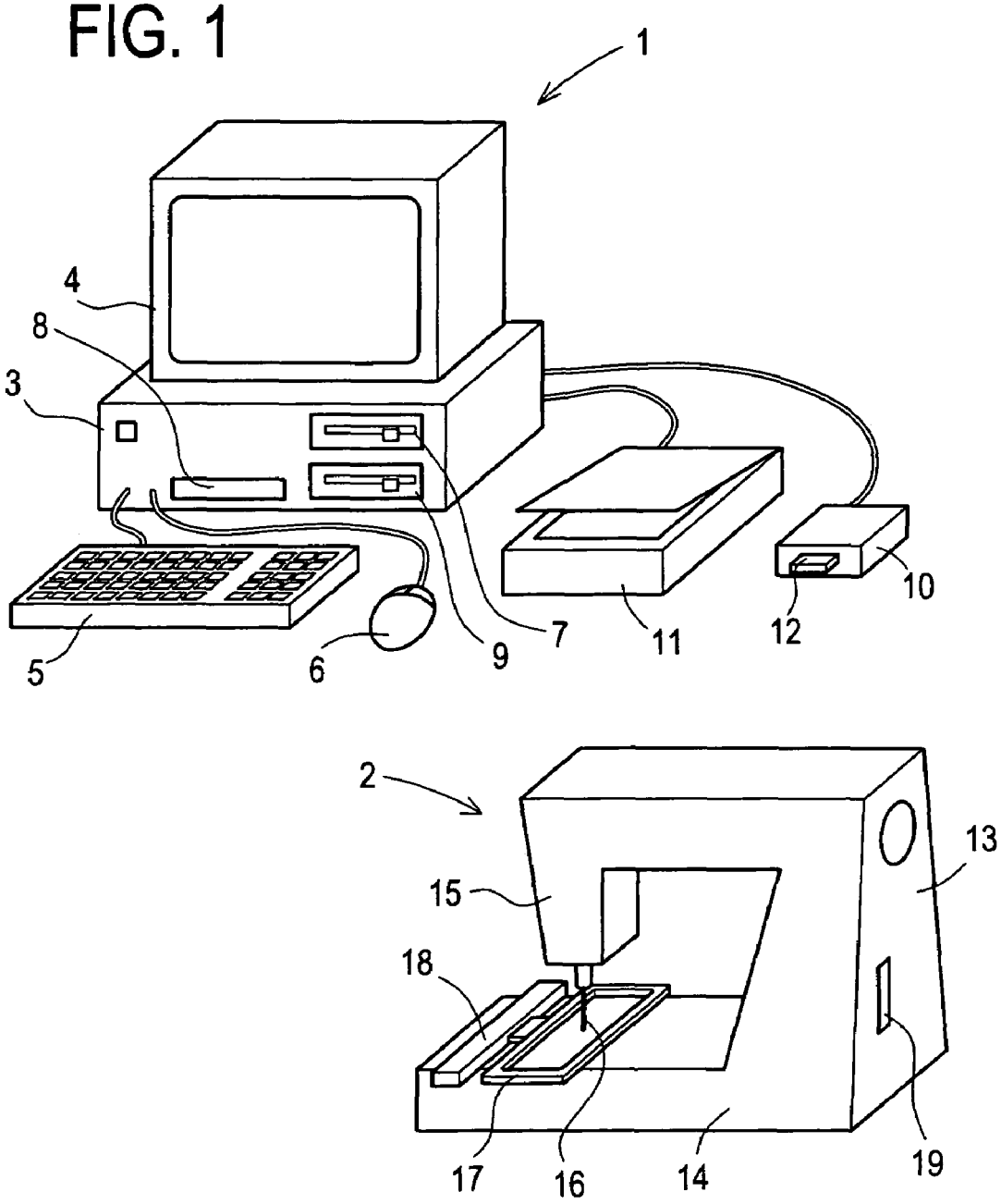
FIG. 1 is a perspective view of an outline of an embroidery data processing device in exemplary embodiment 1.

In FIG. 1, an embroidery data processing device 1 mainly comprises a control main body 3. The control main body 3 has a CRT display 4 for displaying an image, a pattern, a text and the like. The control main body 3 also includes a keyboard 5, a mouse 6, a flexible disk (FD) device 7, a hard disk drive 8, a CD-ROM device 9, a flash memory device 10, and an image scanner 11.

In the flexible disk device 7, a flexible disk 7A (see FIG. 2) is detachably loaded as a recording medium storing various programs, including a tree structure vector coupling process program for coupling plural pieces of independent tree structure vector data described below to create a single unit of tree structure vector data, a tree structure vector dividing process program for dividing the single unit of the tree structure vector data into plural pieces of tree structure vector data, and an embroidery data processing program for creating consecutive embroidery data from the tree structure vector data. The hard disk drive 8 stores image data, outline data, tree structure vector data, embroidery data and others in the hard disk, or reads them out from the hard disk. The CD-ROM device 9 reads out the image data, the outline data, the tree structure vector data, the embroidery data and others recorded in the CD-ROM. The flash memory device 10 has a detachable memory card 12 such as a nonvolatile flash memory, and is designed to write the embroidery data and others into the memory card 12. The image scanner 11 is designed to read an original image of the embroidery pattern.

Such programs can be recorded in a computer readable recording medium such as a semiconductor memory, a hard disk, a Floppy (registered trademark) disk, a data card (for instance, an IC card and a magnetic card), an optical disk (for instance, CD-ROM and DVD), a magneto-optical disk (For instance, MD), a phase change disk, and a magnetic tape, and can be used by loading in the computer and starting up as required. Besides, programs can be stored in the ROM or backup RAM, and may be used by loading the ROM or backup RAM in the computer.

A sewing machine main body 13 of an embroidery machine 2 has an arm 15 formed integrally above a bed 14. The leading end of the arm 15 has a needle bar (not shown) having a sewing needle 16. Above the bed 14, an embroidery frame 17 for holding a fabric (not shown) is disposed. The embroidery frame 17 is designed to be moved to an arbitrary position depending on the own XY coordinate system of the device by means of an embroidery frame moving mechanism 18. By driving the needle bar and a hook mechanism (not shown) while freely moving the fabric by the embroidery frame moving mechanism 18, an embroidery motion is executed on the fabric to form specified embroidery.

Further, at the right side of the sewing machine main body 13, a card slot 19 is provided for loading a memory card 12.

The embroidery frame moving mechanism 18 and the needle bar and others are controlled by a control device (not shown) composed of a microcomputer and others. In the control device, the embroidery data is given from outside by the memory card 12. Therefore, the control device can execute an embroidery forming operation automatically on the basis of the data instructing the moving distance (a needle drop point) in XY direction of a fabric stitch by stitch in the embroidery data.

Figure 2:
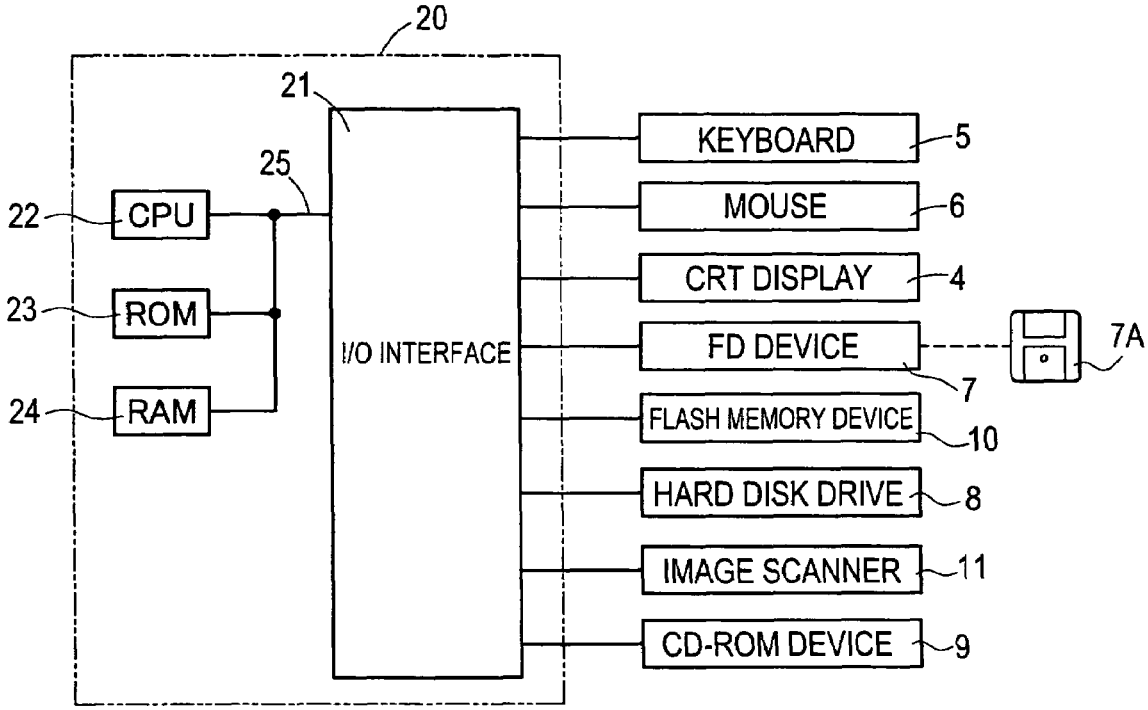
FIG. 2 is a block diagram of a control system of the embroidery data processing device.

An electrical configuration of the embroidery data processing device is explained with reference to FIG. 2. FIG. 2 is a block diagram showing a control system of the embroidery data processing device.

In FIG. 2, a control device 20 built in the control main body 3 is composed mainly of a circuit of a microcomputer, and includes an input and output (I/O) interface 21, a CPU 22, a ROM 23, and a RAM 24 connected mutually through a bus line 25.

The I/O interface 21 is connected to the CRT display 4, the keyboard 5, the mouse 6, the flexible disk (FD) device 7, the flash memory device 10, the hard disk drive 8, the image scanner 11, and the CD-ROM device 9.

In this configuration, the control device 20 reads the tree structure vector coupling process program, the tree structure vector dividing process program, the embroidery data processing program, and other embroidery data stored in the flexible disk 7A through the flexible disk device 7, and executes the embroidery data creating process according to the read programs.

The ROM 23 stores control programs necessary for operating the embroidery data processing device 1, and various programs for processing other embroidery data. The RAM 24 includes an image memory area for storing the image data corresponding to the original image of embroidery being read through the image scanner 11, drawing information memory area for storing drawing information created on the basis of the image data, the tree structure vector memory area for storing the tree structure vector data created from the drawing information, the embroidery data memory area for storing the embroidery data created from the tree structure vector data and the embroidery data read out from the flexible disk 7A, and other various data memory regions necessary for creating other embroidery data.

Examples of the tree structure vector data stored in the tree structure vector memory area created on the basis of drawing information stored in the drawing information memory area of the RAM 24 are explained with reference to FIG. 3 and FIG. 4. The drawing information and the tree structure vector data are created from the image data of the original drawing acquired through the image scanner 11 as known well (see, for example, Japanese patent application laid-open No. H8-38756).

Figure 3:
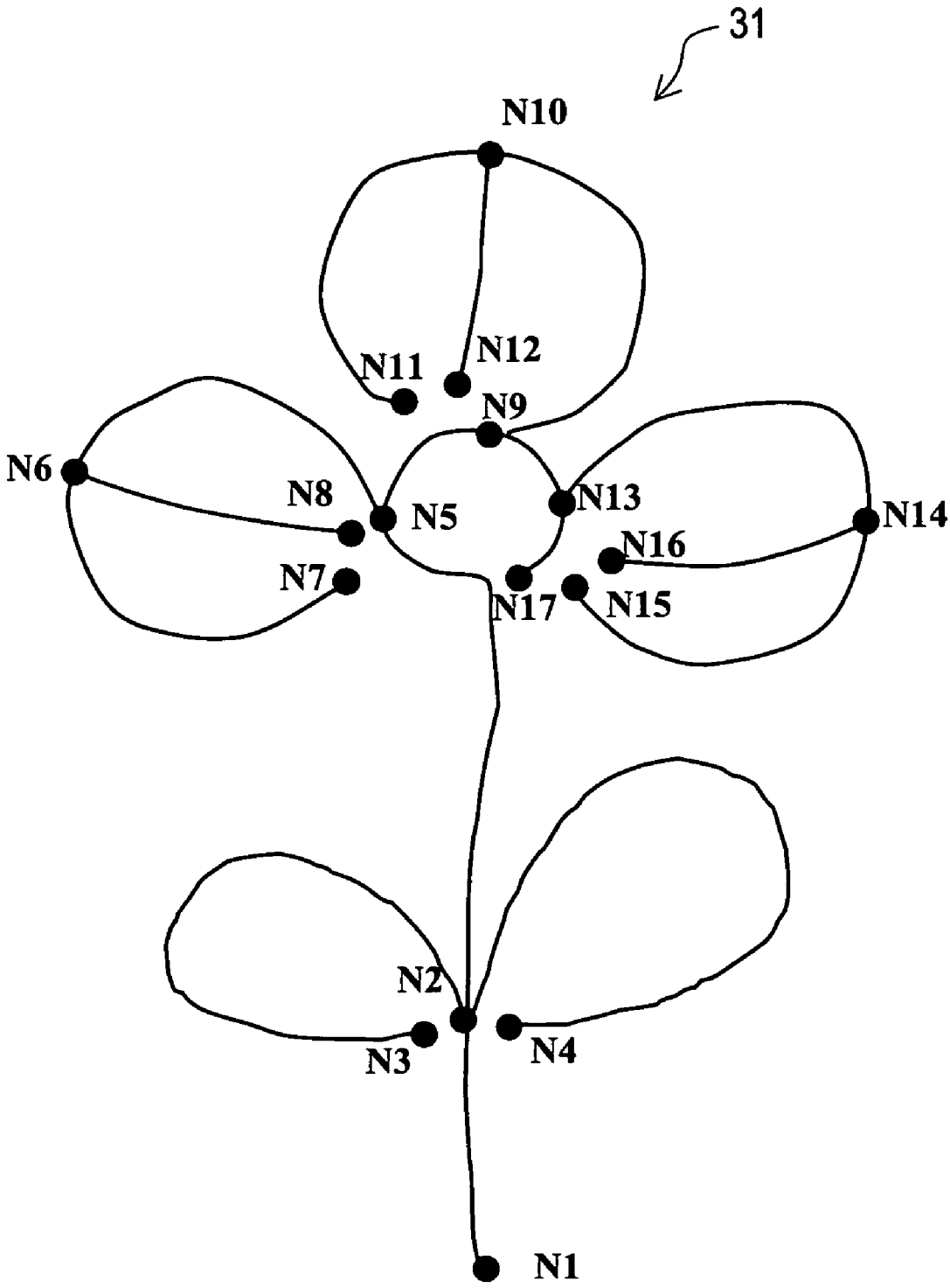
FIG. 3 is a diagram showing an example of a display of drawing information stored in a drawing information memory area of a RAM on a CRT display.
Figure 4:
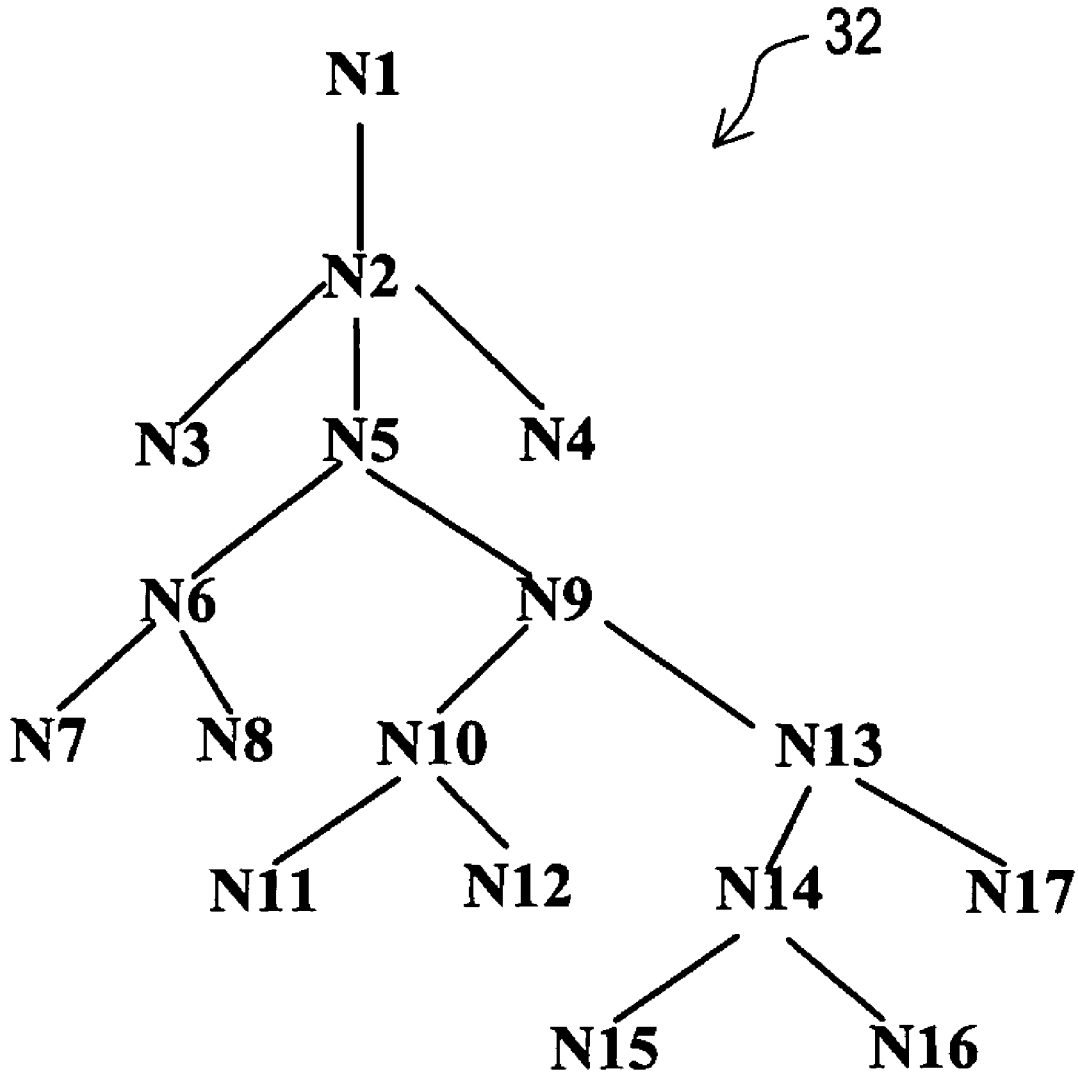
FIG. 4 is a diagram of an example of the tree structure vector data created from the drawing shown in FIG. 3.

As shown in FIG. 3 and FIG. 4, in the line drawing 31 displayed on the CRT display 4 of a pixel 1 being further narrowed in line width and formed into a vector on the basis of the image data acquired from the original image, a point N1 at the lowest position is set at a root node N1. From this root node N1, the tree structure vector data 32 for linking nodes N2 to N17 is created, and stored in the tree structure vector memory area of the RAM 24.

Embroidery data 33 created on the basis of the tree structure vector data 32 is explained with reference to FIG. 5 and FIG. 6. As known well, the embroidery data 33 is created on the basis of the vector data coupling from the root node N1 composing the tree structure vector data 32 to end nodes N3, N4, N7, N8 N11, N12, N15, N16, N17 (see, for example, Japanese patent application laid-open No. H8-38756).

As shown in FIG. 5, the embroidery data 33 is composed of "sewing sequence" for forming an embroidery pattern, "sewing start node" showing the position of the node for setting the needle drop point of start of sewing of each sewing sequence, "sewing end node" showing the position of node for setting needle drop point of end of sewing of each sewing sequence, and "sewing manner" showing stitch of each sewing sequence. In the embroidery data 33, therefore, the embroidery data for forming continuous stitches from first to thirtieth sewing sequences is stored.

For example, the first sewing sequence stores the embroidery data (embroidery stitch sewing data) forming satin stitches corresponding to "zigzag" sewing manner from the position of the end node N3 to the position of the node N2.

The second sewing sequence stores embroidery data (running stitch sewing data) forming running sewing stitches corresponding to "running" sewing manner from the position of node N2 to the position of node N5.

The third sewing sequence stores embroidery data (running stitch sewing data) forming running sewing stitches corresponding to "running" sewing manner from the position of the node N5 to the position of the node N6.

Figure 6:
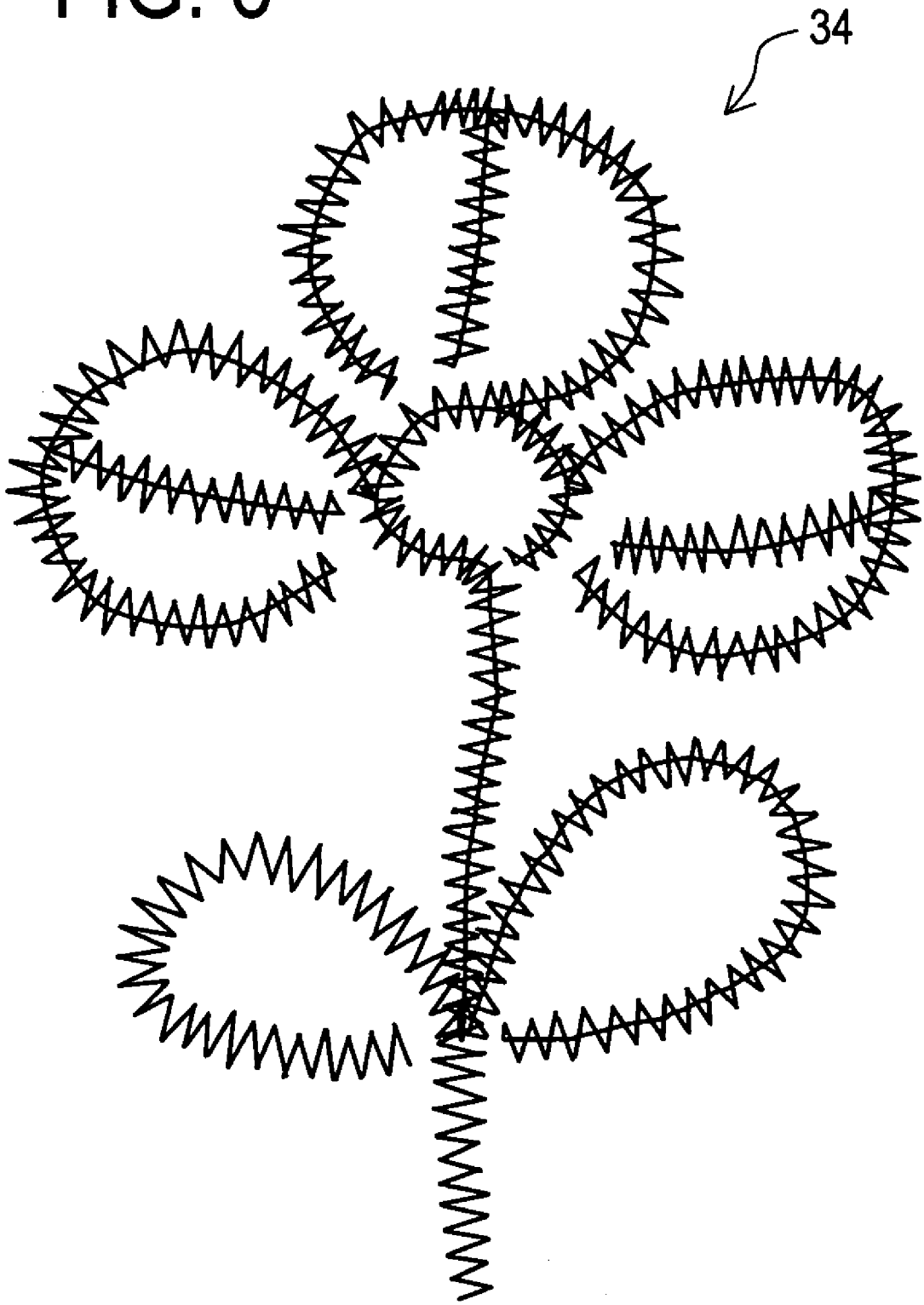
FIG. 6 is a diagram of an example of an embroidery stitch sewn according to the embroidery data shown in FIG. 5.

Therefore, as shown in FIG. 6, the stitch of the embroidery pattern 34 sewn on the basis of the embroidery data 33 forms continuous stitches, that is, forms running stitch sewing from the root node to the end node, and forms satin stitch sewing (embroidery stitch sewing) from the end node to the root node, and stitches of each running stitch sewing are covered with stitches of satin stitch sewing (embroidery stitch sewing), and useless jump stitch is not formed on the finished embroidery.

Process of creating the embroidery data in consecutive sewing sequence not causing jumping by creating a single unit of the tree structure vector data by coupling independent tree structure vector data to the tree structure vector data is explained with reference to FIG. 7 to FIG. 14. In the following explanation, independent tree structure vector data is coupled to the tree structure vector data 32 corresponding to the line drawing 31.

FIG. 7 to FIG. 12 explain the tree structure vector data coupling process for creating the single unit of the tree structure vector data by coupling the independent tree structure vector data to the existing tree structure vector data.

Figure 7:
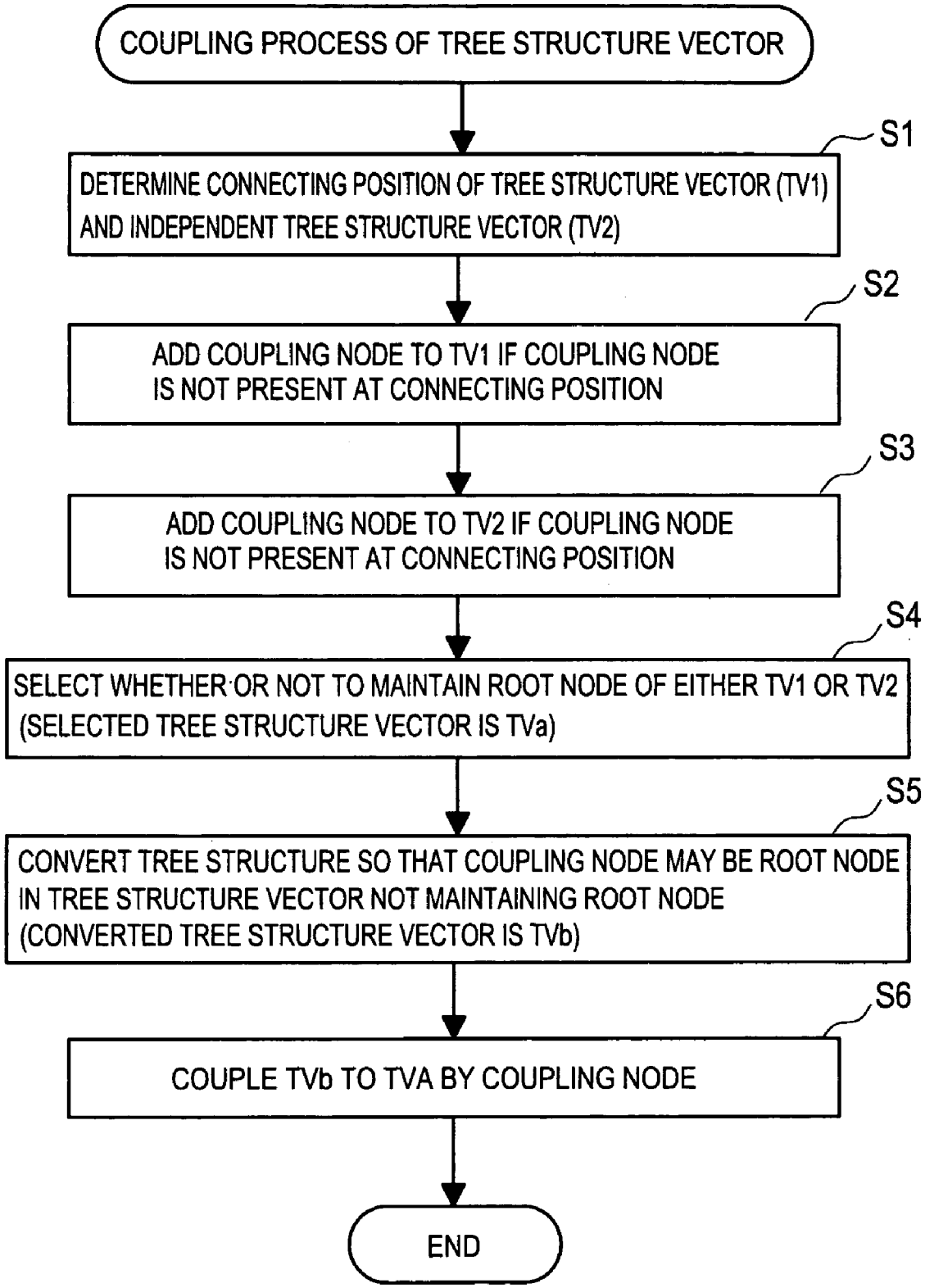
FIG. 7 is a flowchart of a tree structure vector coupling process program for creating a single unit of tree structure vector data by coupling an independent tree structure vector data to the tree structure vector data.
Figure 8:
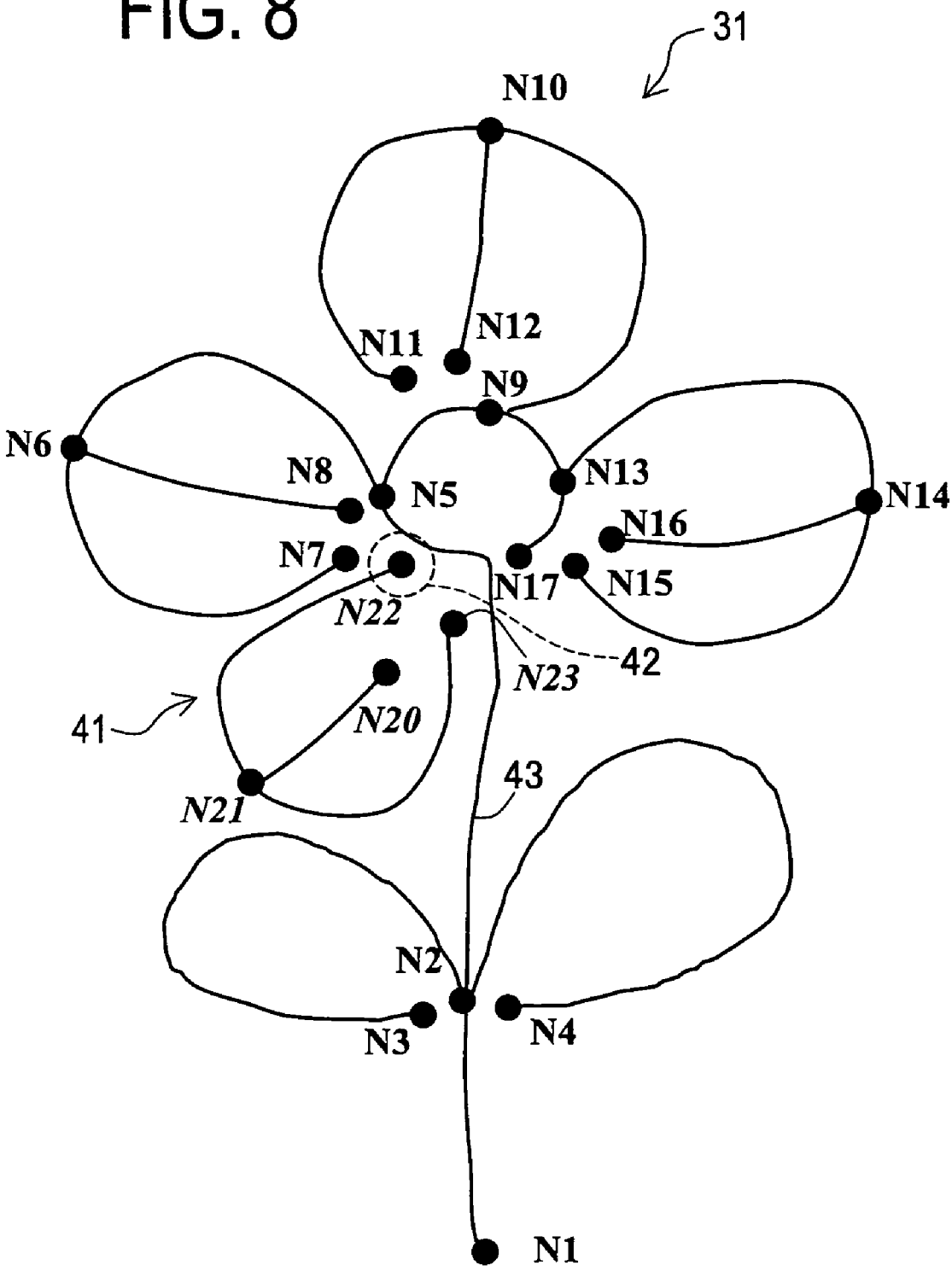
FIG. 8 is a diagram of an example of a display screen for coupling the independent tree structure vector data to the tree structure vector data by way of the line drawing displayed on the display screen.
Figure 9:
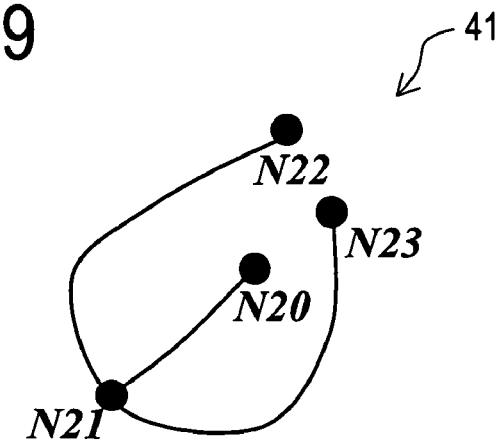
FIG. 9 is a magnified view showing the line drawing to be coupled in FIG. 8.

As shown in FIG. 7 to FIG. 9, first in step 1 (S1), the CPU 22 reads out drawing information of line drawings 31 and 41 from the drawing information memory area of the RAM 24, and displays line drawings 31 and 41 on the CRT display 4. The user moves the line drawing 41 close to a position for coupling to the line drawing 31 by using the mouse 6, and by clicking the connecting position of the line drawing 31 and the line drawing 41 by the mouse 6, the connecting position 42 is displayed in a small circle of a broken line. As a result, the CPU 22 determines connection of node N22 of line drawing 41 existing in the connecting position 42, and the portion existing in the connecting position 42 of the line 43 for coupling nodes N2 and N5 of the line drawing 31. That is, vector data N2 to N5 for coupling nodes N2 and N5 of the tree structure vector data 32 (TV1) of the line drawing 31, and the node N22 of the tree structure vector data 42 (TV2) of the line drawing 41 are determined as the connecting position 42.

Figure 11:
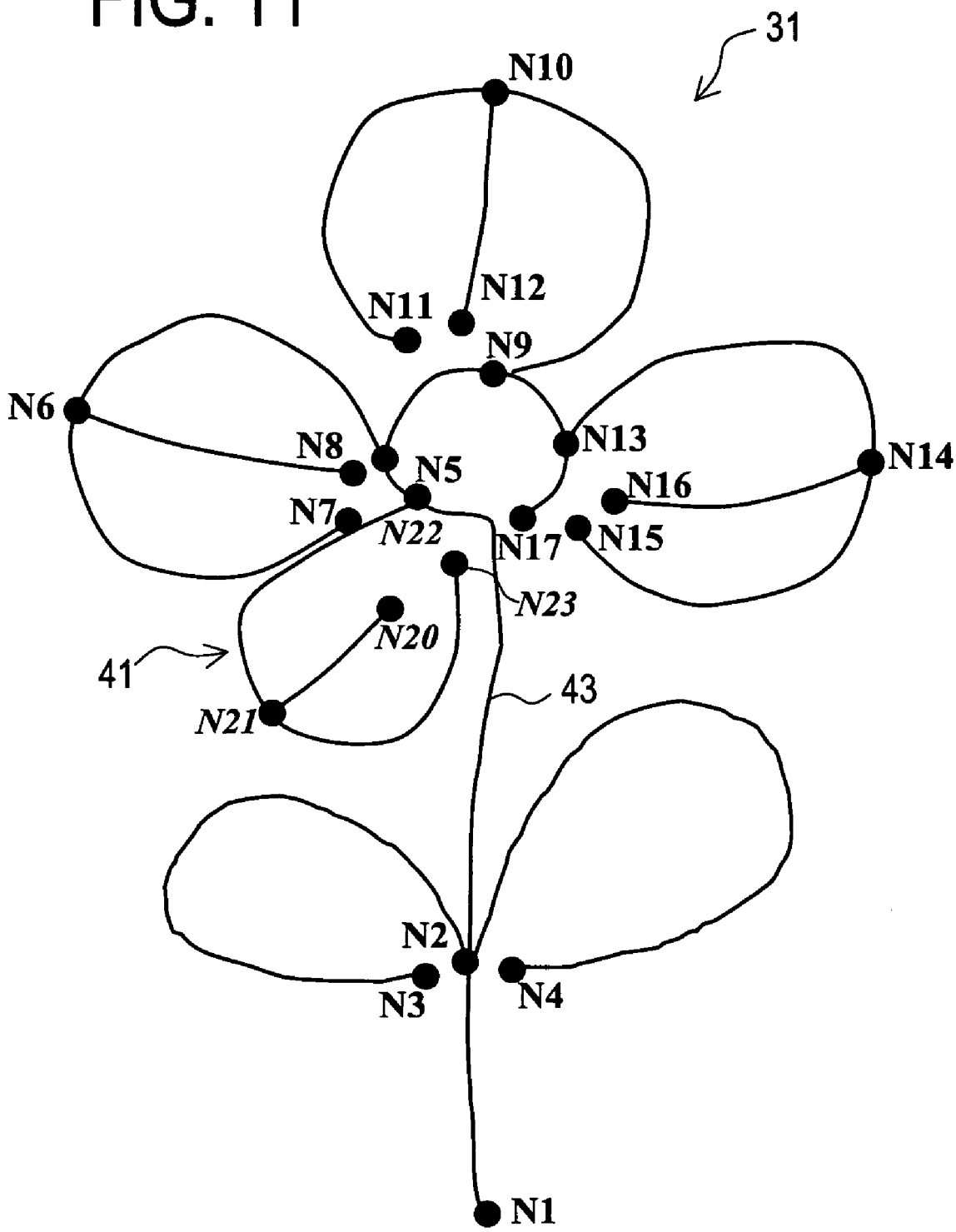
FIG. 11 is a diagram of an example of the line drawing coupling the line and the node at the connection position in FIG. 8.

In S2, the CPU 22 judges if there is a node for coupling on the line 43 or not existing in the connecting position 42 of the line drawing 31 displayed on the CRT display 4. As shown in FIG. 8, if there is no node for coupling on the line 43 existing in the connecting position 42 of the line drawing 31, as shown in FIG. 11, the CPU 22 adds the coupling node N22 to the position closest to the node N22 of the line drawing 41 on the line 43 in the connecting position 42.

Figure 12:
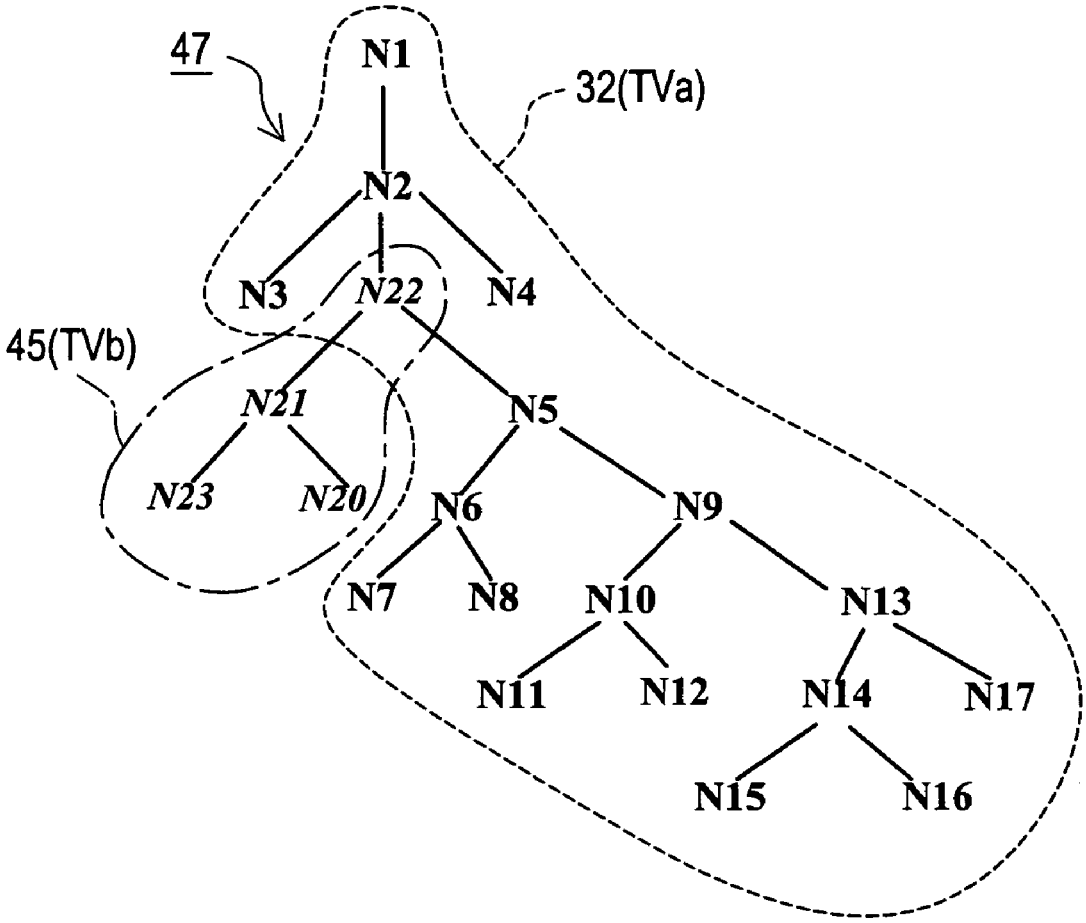
FIG. 12 is a diagram of an example of the tree structure vector data created from the line drawing in FIG. 11.

Further, as shown in FIG. 12, the CPU 22 adds the coupling node N22 between nodes N2 and N5 of the tree structure vector data 32 (TV1), and creates the vector data N2 to N22 for coupling between nodes N2 and N22, and the vector data N22 to N5 for coupling between nodes N22 and N5, and stores in the tree structure vector memory area.

On the other hand, if there is a node for coupling on the line 43 existing in the connecting position 42 of the line drawing 31, the CPU 22 does not add a coupling node to the tree structure vector data 32 (TV1).

Figure 10:
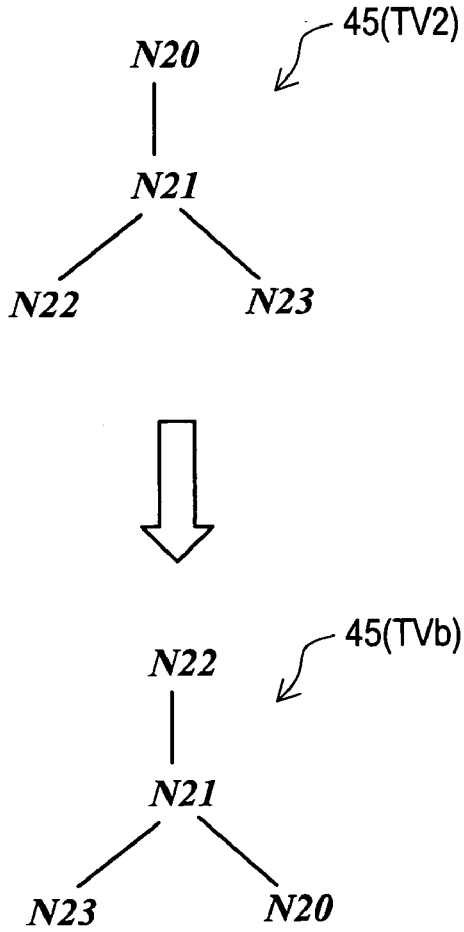
FIG. 10 is a diagram of the tree structure converting the node existing at the connection position of the tree structure vector data corresponding to the line drawing in FIG. 9 into the root node.

Successively, in S3, the CPU 22 judges if there is a node for coupling or not existing in the connecting position 42 of the line drawing 41 displayed on the CRT display 4. As shown in FIG. 8, if there is the node N22 for coupling existing in the connecting position 42 of the line drawing 41, as shown in FIG. 10, the CPU 22 does not add a coupling node to the tree structure vector data 45 (TV2) of the line drawing 41.

On the other hand, if there is no node for coupling existing in the connecting position 42 of the line drawing 41, the CPU 22 adds a coupling node to the line existing in the connecting position 42 of the line drawing 31 or the position closest to the node, on the line existing in the connecting position 42 of the line drawing 41. The CPU 22 further adds a coupling node to the tree structure vector data 45 (TV2).

In S4, the CPU 22 selects to maintain which root node out of the root node N1 of the tree structure vector data 32 (TV1) or the root node N20 of the tree structure vector data 45 (TV2). For example, the CPU 22 selects to maintain the root node N1 of the tree structure vector data 32 greater in the number of nodes out of tree structure vector data 32 and 45, and stores the tree structure vector data 32 (TVa) having the root node N1 again in the tree structure vector memory area.

In S5, the CPU 22 converts the mutual direction of nodes N20, N21, N22, N23 so that the node N22 existing at the connecting position 42 may be the root node, in the tree structure vector data 45 (TV2) not maintaining the root node as shown in FIG. 10, and stores again in the tree structure vector memory area as the tree structure vector data 45 (TVb) having the root node N22.

In S6, the CPU 22 overlays the root node N22 of the line drawing 41 on the coupling node N22 on the line 43 of the line drawing 31 as shown in FIG. 11, and displays on the CRT display 4. The CPU 22 further reads out, as shown in FIG. 12, the tree structure vector data 32 (TVa) and the tree structure vector data 45 (TVb) from the tree structure vector memory area of the RAM 24, couples the root node N22 of the tree structure vector data 45 (TVb) to the coupling node N22 to which the tree structure vector data 32 (TVa) is added, creates a single piece of tree structure vector data 47, stores in the tree structure vector memory area, and terminates this sub-process, and returns to the main flowchart.

In succession, the embroidery data 49 created on the basis of the tree structure vector data 47 is explained with reference to FIG. 13 and FIG. 14. The embroidery data 49 is composed, as known well, on the basis of the vector data coupled from the root node N1 composing the tree structure vector data 47 to the end nodes N3, N4, N20, N23, N7, N8, N11, N12, N15, N16, N17 (see, for example, Japanese patent application laid-open No. H8-38756).

As shown in FIG. 13, the embroidery data 49 is substantially same as the embroidery data 33 (see FIG. 5), but by the coupling of the tree structure vector data 45 (TVb), sewing sequences 2 to 9 are added instead of sewing sequence 2 of the embroidery data 33. In the embroidery data 49, further, sewing sequences 34 and 35 are added instead of sewing sequence 27 of the embroidery data 33. The embroidery data 49 stores the embroidery data for forming consecutive stitches from the first to the thirty-eighth sewing sequence.

For example, the first sewing sequence stores the embroidery data (embroidery stitch sewing data) forming satin stitches corresponding to "zigzag" sewing manner from the position of the end node N3 to the position of the node N2.

The second sewing sequence stores the embroidery data (running stitch sewing data) forming running stitches corresponding to "running" sewing manner from the position of the node N2 to the position of the node N22.

The third sewing sequence stores the embroidery data (running stitch sewing data) forming running stitches corresponding to "running" sewing manner from the position of the node N22 to the position of the node N21.

The fourth sewing sequence stores the embroidery data (running stitch sewing data) forming running stitches corresponding to "running" sewing manner from the position of the node N21 to the position of the node N20.

Figure 14:
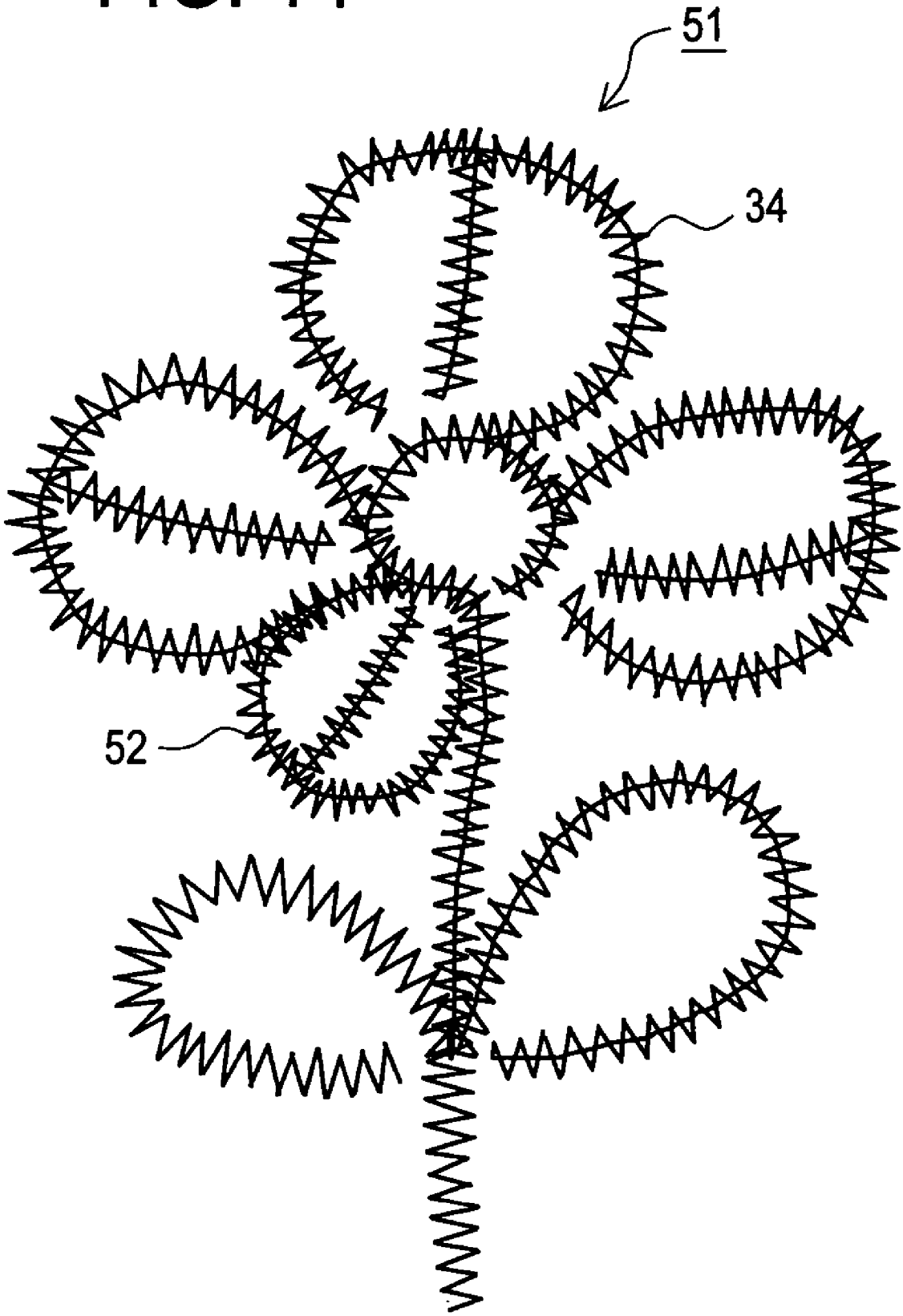
FIG. 14 is a diagram of an example of the embroidery stitch sewn on the basis of the embroidery data in FIG. 13.

Therefore, as shown in FIG. 14, stitches of an embroidery pattern 51 sewn on the basis of the embroidery data 49 form consecutive stitches adding an embroidery pattern 52 corresponding to the line drawing 41 to the embroidery pattern 34, and each running stitch is covered by satin stitches (embroidery stitch), and useless jump stitch is not formed on the finished embroidery. As for the tree structure vector data 32 (TVa) set to maintain the root node, since direction of nodes is not changed, sewing direction is not changed in sewing by running stitch sewing or satin stitch sewing (embroidery stitch sewing data), and the node N1 of the end point of sewing is maintained.

Other example of a coupling process of the tree structure vector for creating a single piece of tree structure vector data by coupling the independent tree structure vector data to the existing tree structure vector data is explained with reference to FIG. 15 to FIG. 21.

Figure 15:
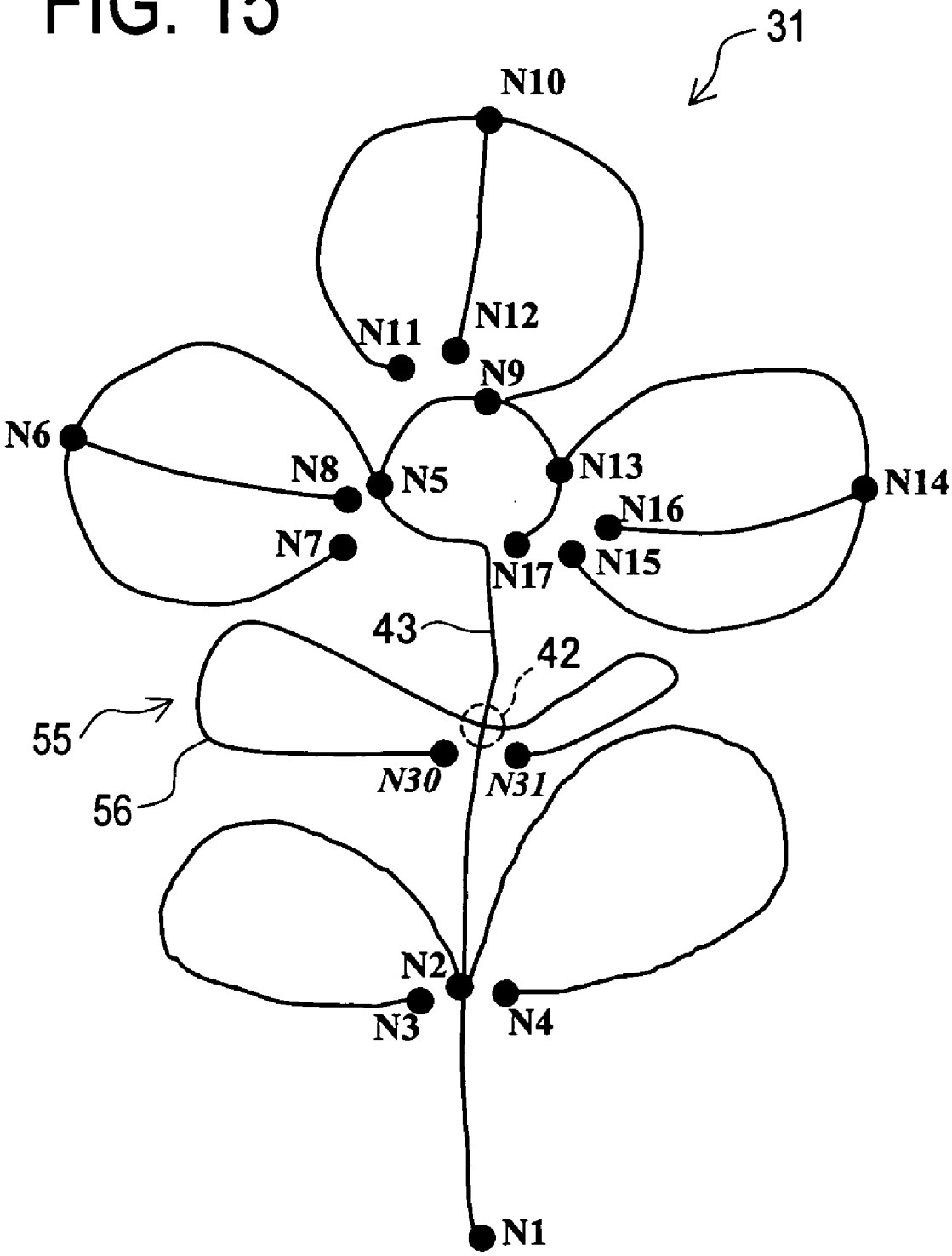
FIG. 15 is a diagram of other example of the display screen for coupling the independent tree structure vector data to the tree structure vector data by way of the line drawing displayed on display screen.

As shown in FIG. 15, in S1, the CPU 22 reads out drawing information of line drawings 31 and 55 from the drawing information memory area of the RAM 24, and displays line drawings 31 and 55 on the CRT display 4. The user moves the line drawing 55 to a position coupling to the line drawing 31 and overlays by using the mouse 6, and by clicking the connecting position of the line drawing 31 and the line drawing 55 by the mouse 6, the connecting position 42 is shown in a small circle of a broken line. As a result, the CPU 22 determines connection in the existing area of the connecting position 42 between the line 56 for coupling nodes N30 and N31 of the line drawing 55 existing in the connecting position 42 and the line 43 for coupling nodes N2 and N5 of the line drawing 31. That is, the overlaying position of the line 43 of the line drawing 31 and the line 56 of the line drawing 55 is determined as the connecting position 42.

Figure 18:
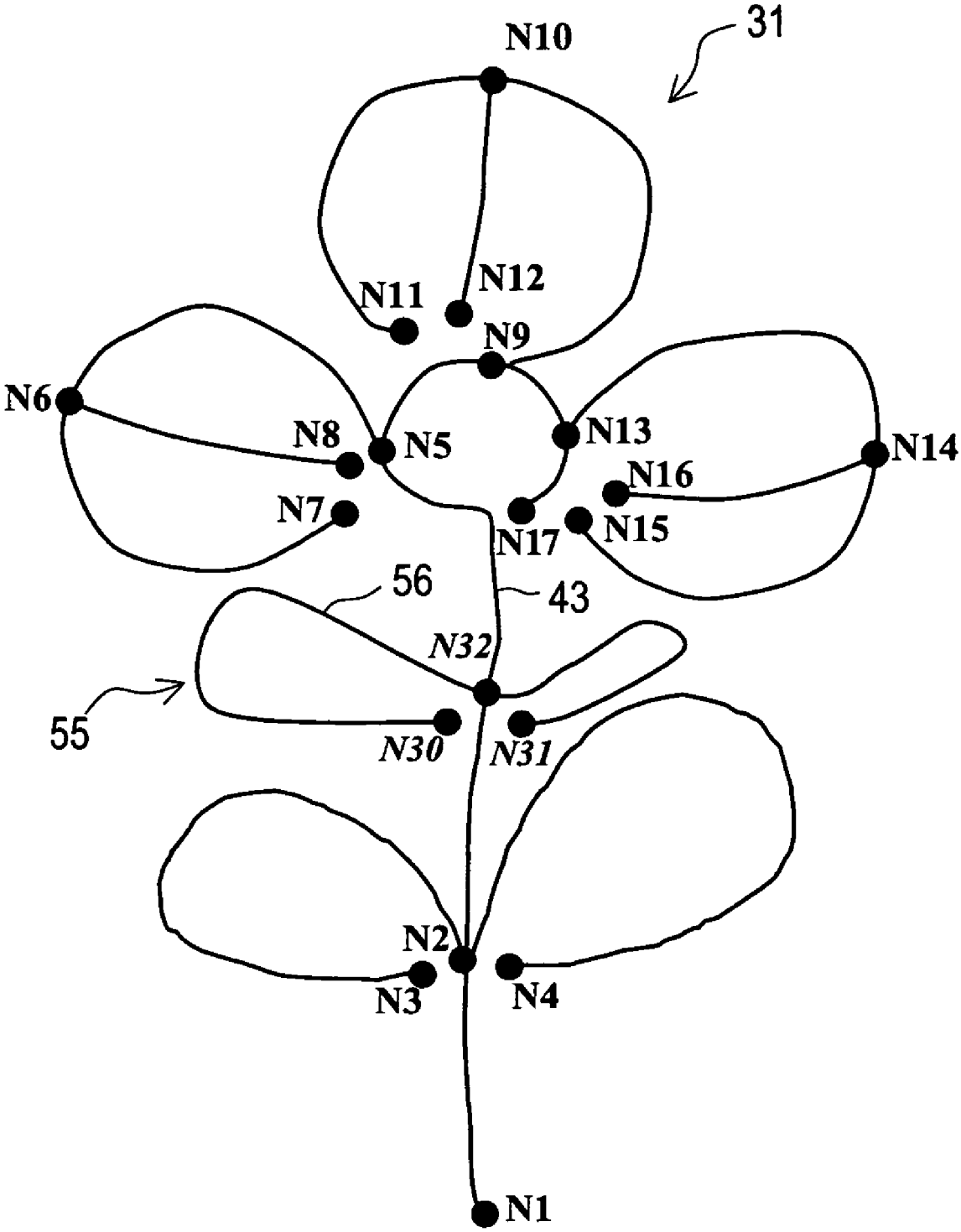
FIG. 18 is a diagram of an example of the line drawing coupling the line and the line at the connection position in FIG. 15.

In S2, the CPU 22 judges if there is a node or not for coupling on the line 43 existing in the connecting position 42 of the line drawing 31 displayed on the CRT display 4. As shown in FIG. 15, if there is no node for coupling on the line 43 existing in the connecting position 42 of the line drawing 31, as shown in FIG. 18, the CPU 22 adds the coupling node N32 to the closest position to the line drawing 56, that is, overlaid position on the line 43 in this connecting position 42.

Figure 19:
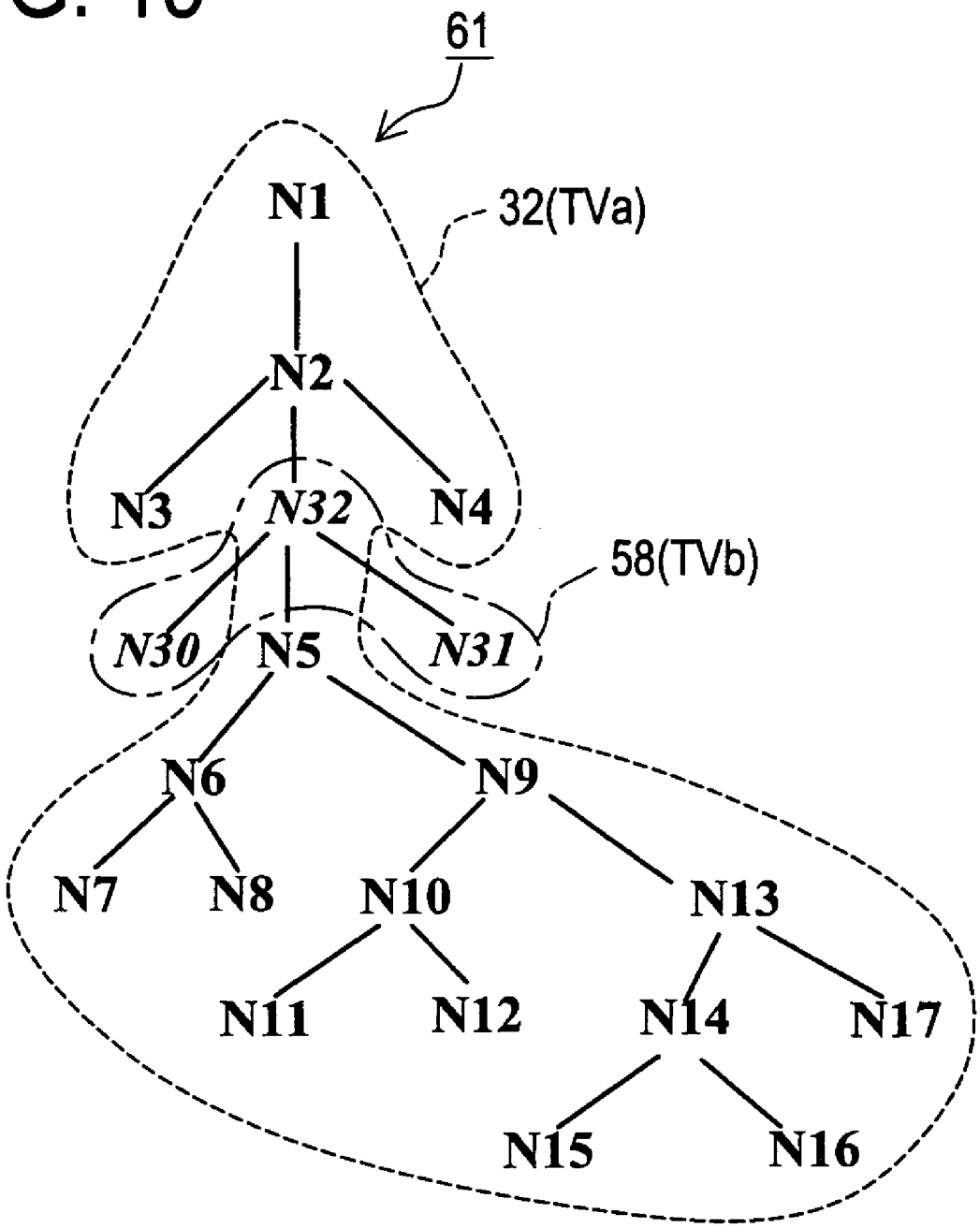
FIG. 19 is a diagram of an example of the tree structure vector data created from the line drawing in FIG. 18.

Further, as shown in FIG. 19, the CPU 22 adds the coupling node N32 between nodes N2 and N5 of the tree structure vector data 32 (TV1), creates the vector data N2 to N32 for coupling between nodes N2 and N32, and the vector data N32 to N5 for coupling between nodes N32 and N5, and stores in the tree structure vector memory area.

Figure 16:
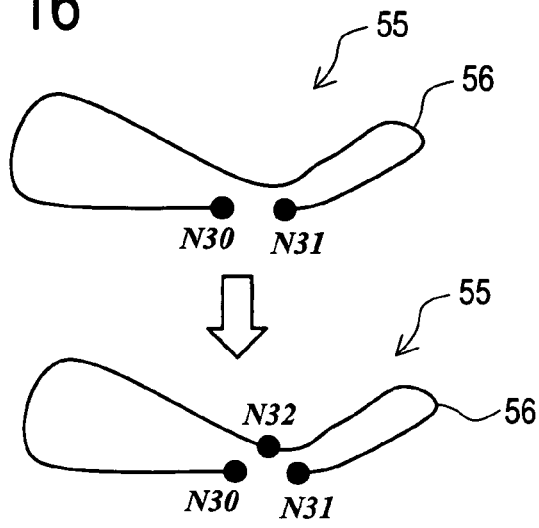
FIG. 16 is a magnified view showing addition of a coupling node to the connection position of the line drawing to be coupled in FIG. 15.

In succession, in S3, the CPU 22 judges if there is a node or not for coupling in the connecting position 42 of the line drawing 55 displayed on the CRT display 4. As shown in FIG. 15, if there is no node for coupling in the connecting position 42 of the line drawing 56, as shown in FIG. 16, the CPU 22 adds the coupling node N32 to the closest position to the line drawing 43, that is, overlaid position on the line 56 in this connecting position 42.

Figure 17:
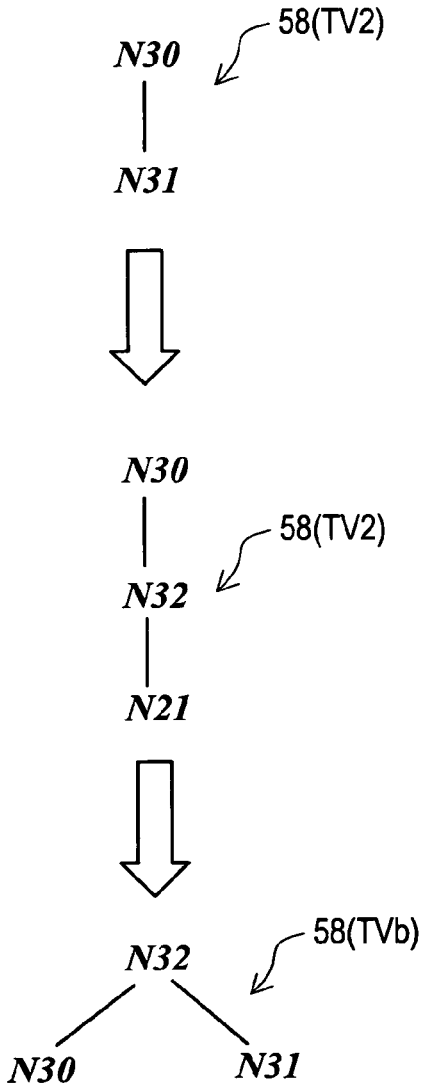
FIG. 17 is a diagram of the tree structure converting the node existing at the connection position of the tree structure vector data corresponding to the line drawing in FIG. 16 into the root node.

Further, as shown in FIG. 17, the CPU 22 adds the coupling node N32 between nodes N30 and N31 of the tree structure vector data 58 (TV2) corresponding to the line drawing 55, creates the vector data N30 to N32 for coupling between nodes N30 and N32, and the vector data N32 to N31 for coupling between nodes N32 and N31, and stores in the tree structure vector memory area.

In S4, the CPU 22 selects to maintain which root node out of the root node N1 of the tree structure vector data 32 (TV1) and the root node N30 of the tree structure vector data 58 (TV2). For example, the CPU 22 selects to maintain the root node N1 of the tree structure vector data 32 greater in the number of nodes out of tree structure vector data 32 and 58, and stores again in the tree structure vector memory area as the tree structure vector data 32 (TVa) having the root node N1.

In succession, in S5, the CPU 22 converts the mutual direction of nodes N30, N31, N32, so that the coupling node N32 existing at the connecting position 42 may be the root node, in the tree structure vector data 58 (TV2) not maintaining the root node as shown in FIG. 17, and stores again in the tree structure vector memory area as the tree structure vector data 58 (TVb) having the root node N32.

In S6, the CPU 22 overlays the root node N32 on the line 56 of the line drawing 55 on the coupling node N32 on the line 43 of the line drawing 31 as shown in FIG. 18, and displays on the CRT display 4. The CPU 22 further reads out, as shown in FIG. 19, the tree structure vector data 32 (TVa) and the tree structure vector data 58 (TVb) from the tree structure vector memory area of the RAM 24, couples the root node N32 of the tree structure vector data 58 (TVb) to the coupling node N32 to which the tree structure vector data 32 (TVa) is added, creates a single piece of tree structure vector data 61, stores in the tree structure vector memory area, and terminates this sub-process, and returns to the main flowchart.

In succession, the embroidery data 62 created on the basis of the tree structure vector data 61 is explained with reference to FIG. 20 and FIG. 21. The embroidery data 62 is composed, as known well, on the basis of the vector data coupled from the root node N1 composing tree structure vector data 61, to the end nodes N3, N4, N30, N31, N7, N8, N11, N12 N15, N16, N17 (see, for example, Japanese patent application laid-open No. H8-38756).

As shown in FIG. 20, the embroidery data 62 is substantially same as the embroidery data 33 (see FIG. 5), but by the coupling of the tree structure vector data 58 (TVb), sewing sequences 2 to 7 are added instead of sewing sequence 2 of the embroidery data 33. In the embroidery data 62, further, sewing sequences 32 and 33 are added instead of sewing sequence 27 of the embroidery data 33. The embroidery data 62 stores the embroidery data for forming consecutive stitches from the first to the thirty-sixth sewing sequence.

For example, the first sewing sequence stores embroidery data (embroidery stitch sewing data) forming satin stitches corresponding to "zigzag" sewing manner from the position of the end node N3 to the position of the node N2.

The second sewing sequence stores the embroidery data (running stitch sewing data) forming running stitches corresponding to "running" sewing manner from the position of the node N2 to the position of the node N32.

The third sewing sequence stores the embroidery data (running stitch sewing data) forming running stitches corresponding to "running" sewing manner from the position of the node N32 to the position of the node N30.

The fourth sewing sequence stores the embroidery data (embroidery stitch sewing data) forming satin stitches corresponding to "zigzag" sewing manner from the position of the node N30 to the position of the node N32.

Figure 21:
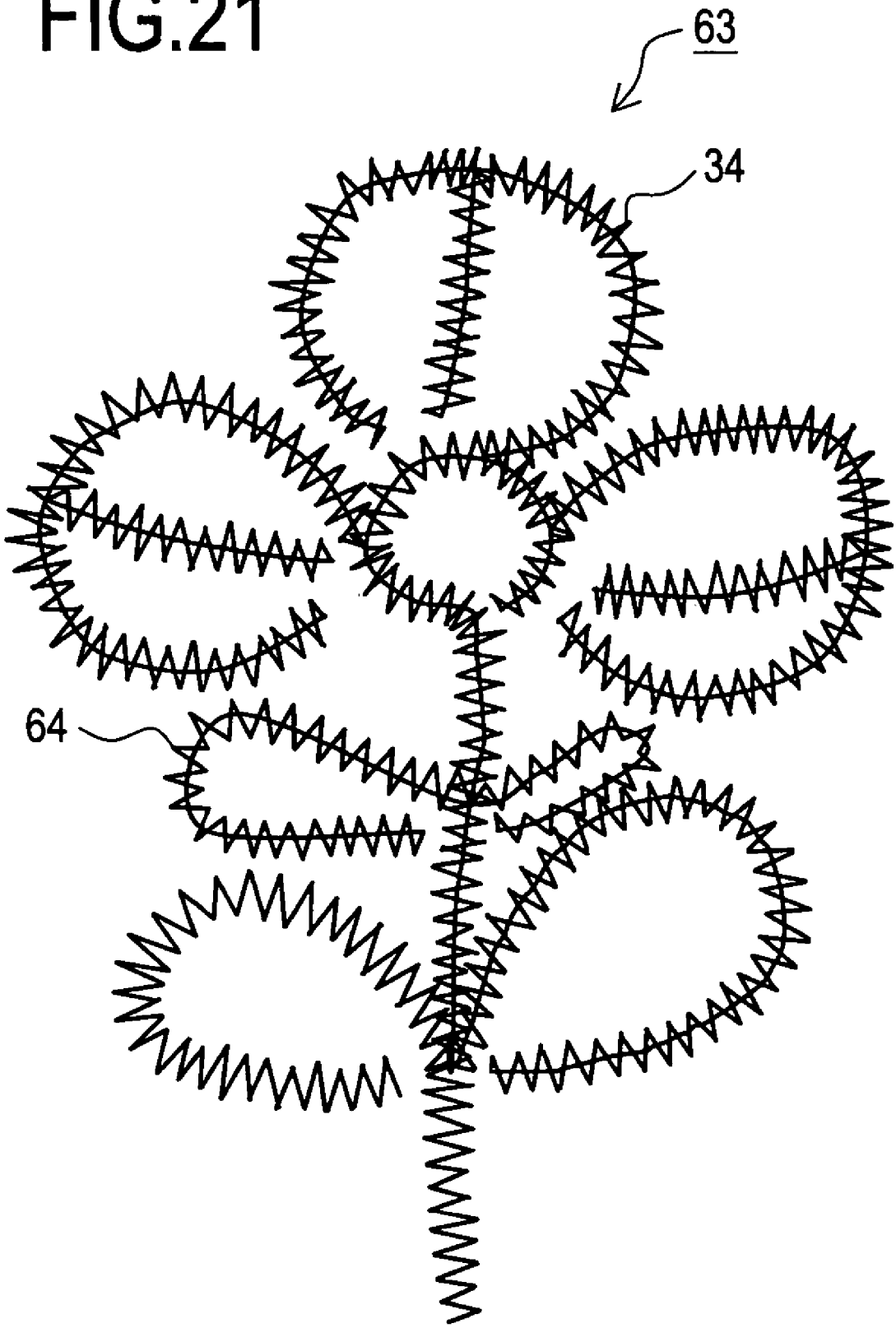
FIG. 21 is a diagram of an example of the embroidery stitch sewn on the basis of the embroidery data in FIG. 20.

Therefore, as shown in FIG. 21, stitches of the embroidery pattern 63 sewn on the basis of the embroidery data 62 form consecutive stitches adding the embroidery pattern 64 corresponding to the line drawing 55 to the embroidery pattern 34, stitches of each running sewing are covered with stitches of satin sewing (embroidery stitch sewing), and useless jump stitch is not formed on the finished embroidery. As for the tree structure vector data 32 (TVa) being set to maintain the root node, since direction of nodes is not changed, sewing direction is not changed in sewing by running stitch sewing or satin stitch sewing (embroidery stitch sewing), and the node N1 of the end point of sewing is maintained.

As specifically described above, in the embroidery data processing device 1 of exemplary embodiment 1, as shown in FIG. 8, if the coupling node is not present on the line 43 existing in the connecting position 42 of the line drawing 31, as shown in FIG. 11, the CPU 22 adds the coupling node N22 to the position closest to the node N22 of the line drawing 41 on the line 43 in the connecting position 42. As shown in FIG. 12, the coupling node N22 is added between nodes N2 and N5 of the tree structure vector data 32 (TV1), and the tree structure vector data 32 (TVa) is created by creating the vector data N2 to N22 for coupling between nodes N2 and N22, and the vector data N22 to N5 for coupling between nodes N22 and N5 (S1 to S3). As shown in FIG. 10, the tree structure vector data 45 (TVb) is created by converting the tree structure so that the node N22 existing in the connecting position 42 may be the root node in the tree structure vector data 45 (TV2) not maintaining the root node. The root node N22 of the tree structure vector data 45 (TVb) is coupled to the coupling node N22 of the tree structure vector data 32 (TVa), and the single unit of the tree structure vector data 47 is created (S4 to S6). The embroidery data 49 of desired consecutive stitches is created on the basis of the tree structure vector data 47.

Hence, the user instructs the connecting position 42 so as to couple the end node of the tree structure vector data 45 on the vector data between arbitrary nodes of the tree structure vector data 32, and can easily couple end nodes of the tree structure vector data 45 on the vector data between arbitrary nodes of this tree structure vector data 32. Accordingly the embroidery pattern 51 desired by the user can be formed easily, and beautiful and high-quality embroidery pattern 51 free from useless jump stitch in finishing can be formed.

The coupling node 22 is added to the position closest to the node N22 on the line 43 existing at the connecting position 42, and the user instructs the connecting position 42 after disposing the line drawing 41 near desired connecting position of the line drawing 31, and the tree structure vector data 32 and 45 can be easily coupled, so that the single unit of the tree structure vector data 47 can be created.

Further, as shown in FIG. 15, if a node is not present in the line drawings 31 and 55 in the connecting position 42, the CPU 22 adds coupling node N32 to the overlaying position of lines 43 and 56 of the line drawings 31 and 55. Further, as shown in FIG. 19, the CPU 22 adds the coupling node N32 between nodes N2 and N5 of the tree structure vector data 32 (TV1), and creates the vector data N2 to N32 for coupling between nodes N2 and N32, and the vector data N32 to N5 for coupling between nodes N32 and N5. The CPU 22 adds coupling node N32 between nodes N30 and N31 of the tree structure vector data 58 (TV2), and creates vector data N30 to N32 for coupling between nodes N30 and N32, and vector data N32 to N31 for coupling between nodes N32 and N31 (S1 to S3). Further, as shown in FIG. 19, the root node N32 of the tree structure vector data 58 (TVb) is coupled to the coupling node N32 to which tree structure vector data 32 (TVa) has been added, and the single unit of the tree structure vector data 61 is created (S4 to S6). On the basis of the tree structure vector data 61, the embroidery data 62 of consecutive stitches is formed.

Accordingly, the user can instruct the connecting position 42 by overlaying the line 56 of the line drawing 55 on an arbitrary line of the line drawing 31, and easily coupling the vector data N30 to N31 of the tree structure vector data 58 on the vector data between arbitrary nodes of the tree structure vector data 32, and can create the single unit of the tree structure vector data 61. Hence, the embroidery pattern 63 desired by the user can be formed easily, and clean embroidery pattern 63 without useless jump stitch in finished state can be formed.

Exemplary Embodiment 2

An embroidery data processing device in exemplary embodiment 2 are described with reference to FIG. 22 to FIG. 28. In the following explanation, same reference numerals as in the embroidery data processing device in exemplary embodiment 1 are same or corresponding parts or components.

An outline of embroidery data processing device in exemplary embodiment 2 is substantially same as in the embroidery data processing device 1 in exemplary embodiment 1. The control process of the embroidery data processing device in exemplary embodiment 2 is substantially same as the control process of the embroidery data processing device 1 in exemplary embodiment 1.

However, the embroidery data processing device in exemplary embodiment 2 is different from the embroidery data processing device 1 in exemplary embodiment 1 only in that the tree structure vector data 32 is divided into the plural pieces of the tree structure vector data.

A dividing process of the tree structure vector for dividing the tree structure vector data 32 into the plural pieces of the tree structure vector data is explained with reference to FIG. 22 to FIG. 28.

Figure 22:
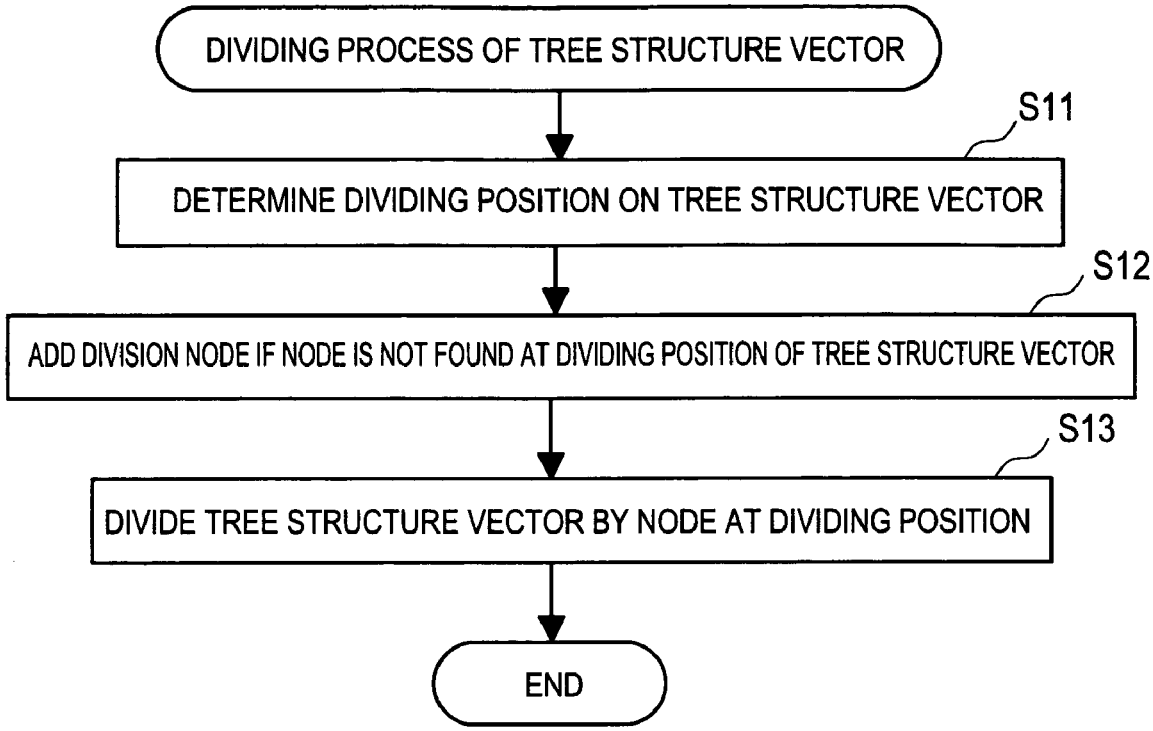
FIG. 22 is a flowchart of the tree structure vector data division process program for dividing the tree structure vector data of the embroidery data processing device in exemplary embodiment 2 into the plural pieces of the independent partial tree structure vector data.

As shown in FIG. 22, in S11, the CPU 22 reads out drawing information of the line drawing 31 from the drawing information memory area of the RAM 24, and displays the line drawing 31 on the CRT display 4. When the user desires to determine the sewing sequence separately by dividing the embroidery pattern 34 (see FIG. 6) by the node N5 of the line drawing 31, the user clicks the node N5 by the mouse 6. When the node N5 is clicked by the mouse 6, the CPU 22 displays a partially magnified view of the node N5 of the line drawing 31 on the CRT display 4. The user manipulates the mouse 6, and moves the cursor to cross the node N5 side edge of the line 71 between the node 5 and the node 6, that is, near the position of the node N5 of the line 71, and the CPU 22 determines the tree structure vector data 32 (see FIG. 4) corresponding to the cursor crossing position as dividing position.

In S12, the CPU 22 judges if there is a node near the cursor crossing position of the line 71. If the node N5 exists near the cursor crossing position of the line 71, this node N5 is stored in the RAM 24 as the division node of the tree structure vector data 32.

On the other hand, if node does not exist near the cursor crossing position of the line 71, division node is added to the cursor crossing position of the line 71, and the division node is added to the vector data N5 to N6 between the node N5 and the node N6 of the tree structure vector data 32, and stored in the tree structure vector data memory area.

Figure 24:
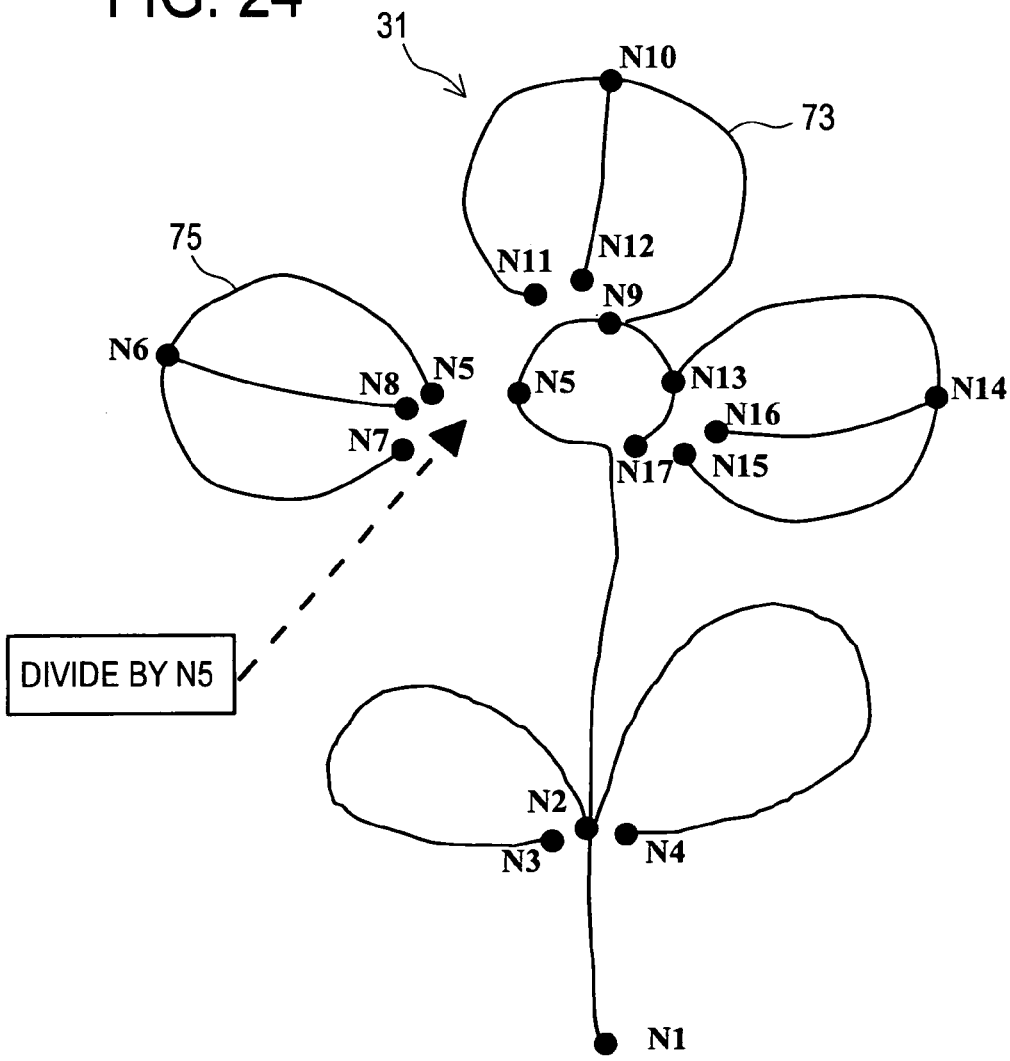
FIG. 24 is a diagram of an example of displaying each line drawing divided at dividing position in FIG. 23.

At S13, as shown in FIG. 24, the CPU 22 reads out the division node from the RAM 24, and when the division node is the node N5, the line drawing 31 is divided by the node N5, into the partial line drawing 73 having the root node N1 and the partial line drawing 75 having nodes N5 to N8, and displayed on the CRT display 4.

When the division node being read out from the RAM 24 is an added division node, the line drawing 31 is divided by this division node, into the partial line drawing having the root node N1 and the partial line drawing having the division node and nodes N6 to N8, and displayed on the CRT display 4.

Figure 25:
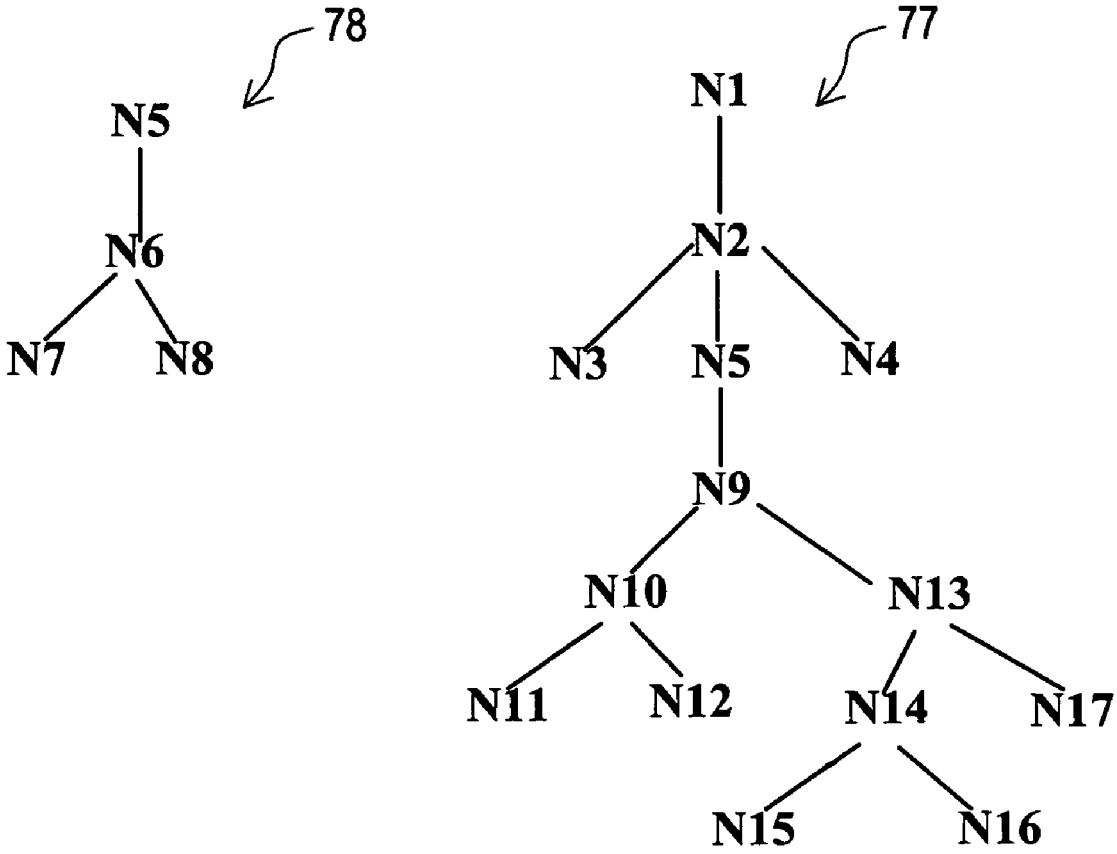
FIG. 25 is a diagram of an example of the partial tree structure vector data corresponding to each divided line drawing in FIG. 24.

As shown in FIG. 25, the CPU 22 divides the tree structure vector data 32 by the division node 5, into the partial tree structure vector data 77 having the root node N1 corresponding to the partial line drawing 73 and the partial tree structure vector data 78 corresponding to the partial line drawing 75. The CPU 22 converts so that the division node N5 of the partial tree structure vector data 78 may be the root node, and stores in the tree structure vector memory area as the partial tree structure vector 78 data having the root node N5. The CPU 22 stores the partial tree structure vector data 77 having the root node N1 in the tree structure vector memory area, and terminates the sub-process and returns to the main flowchart.

On the other hand, when the division node is added to the vector data N5 to N6 between the node N5 and the node N6, the tree structure vector data 32 is divided by this division node, into the one partial tree structure vector data having the root node N1, and the other partial tree structure vector data having the division node and nodes N6 to N8. The division node of the other partial tree structure vector data is converted to be the root node. The one partial tree structure vector data and the other partial tree structure vector data are stored in the tree structure vector memory area, and the CPU 22 terminates the sub-process and returns to the main flowchart.

Embroidery data 81 and 82 crated on the basis of partial tree structure vector data 77 and 78 are explained with reference to FIG. 26 to FIG. 28.

An embroidery data 81 is created, as known well, on the basis of the vector data coupling from the root node N1 composing the partial tree structure vector data 77 to the end nodes N3, N4, N11, N12, N15, N16, N17 (see, for example, Japanese patent application laid-open No. H8-38756). Embroidery data 82 is created, as known well, on the basis of the vector data coupling from the root node N5 composing the partial tree structure vector data 78 to the end nodes N7 and N8 (see, for example, Japanese patent application laid-open No. H8-38756).

As shown in FIG. 26, the embroidery data 81 is substantially same as the embroidery data 33 (see FIG. 5), except that sewing sequences 3 to 8 of the embroidery data 33 are deleted because the nodes N6 to N8 are divided by the node N5 of the tree structure vector data 32. Therefore, the embroidery data 81 stores the embroidery data for forming consecutive stitches from the first to the twenty-fourth sewing sequence.

For example, the first sewing sequence stores the embroidery data (embroidery stitch sewing data) forming satin stitches corresponding to "zigzag" sewing manner from the position of the end node N3 to the position of the node N2.

The second sewing sequence stores the embroidery data (running stitch sewing data) forming running stitches corresponding to "running" sewing manner from the position of the node N2 to the position of the node N5.

The third sewing sequence stores the embroidery data (running stitch sewing data) forming running stitches corresponding to "running" sewing manner from the position of the node N5 to the position of the node N9.

The fourth sewing sequence stores the embroidery data (running stitch sewing data) forming running stitches corresponding to "running" sewing manner from the position of the node N9 to the position of the node N10.

Figure 28:
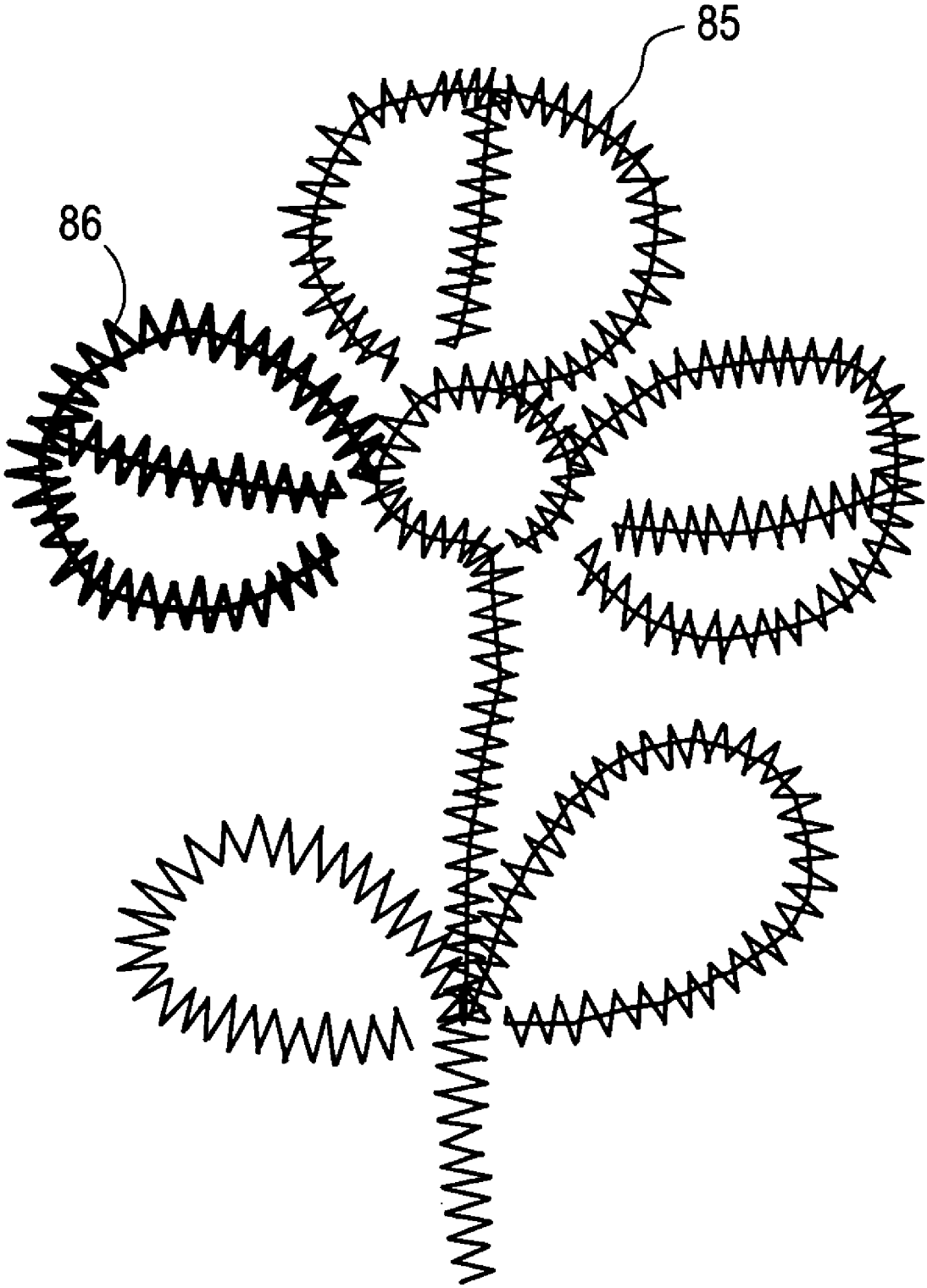
FIG. 28 is a diagram of an example of the embroidery stitch sewn on the basis of the embroidery data shown in FIG. 26 and FIG. 27.

Therefore, as shown in FIG. 28, stitches of the embroidery pattern 85 sewn on the basis of the embroidery data 81 form consecutive stitches corresponding to the partial line drawing 73, stitches of each running sewing are covered with stitches of satin sewing (embroidery stitch sewing), and useless jump stitch is not formed on the finished embroidery.

As shown in FIG. 27, the embroidery data 82 is substantially same as the embroidery data 33 corresponding to nodes N5 to N8 of the tree structure vector data 32, except that sewing sequences 3 to 8 of the embroidery data 33 are replaced by sewing sequences 1 to 6. The embroidery data 82 stores the embroidery data for forming consecutive stitches from the first to the sixth sewing sequence.

For example, the first sewing sequence stores the embroidery data (running stitch sewing data) forming running stitches corresponding to "running" sewing manner from the position of the root node N5 to the position of the node N6.

The second sewing sequence stores the embroidery data (running stitch sewing data) forming running stitches corresponding to "running" sewing manner from the position of the node N6 to the position of the end node N7.

The third sewing sequence stores the embroidery data (embroidery stitch sewing data) forming satin stitches corresponding to "zigzag" sewing manner from the position of the end node N7 to the position of the node N6.

Therefore, as shown in FIG. 28, stitches of the embroidery pattern 86 sewn on the basis of the embroidery data 82 by changing thread colors form consecutive stitches corresponding to the partial line drawing 75, stitches of each running stitch sewing are covered with stitches of satin sewing (embroidery stitch sewing), and useless jump stitch is not formed on the finished embroidery. The embroidery pattern 86 forms consecutive stitches from the position corresponding to the node 5 of the embroidery pattern 85. Direction between nodes is not changed before and after division, and the sewing direction by the running stitch sewing or satin stitch sewing (embroidery stitch sewing) data may be the same as the sewing direction before division.

Figure 23:
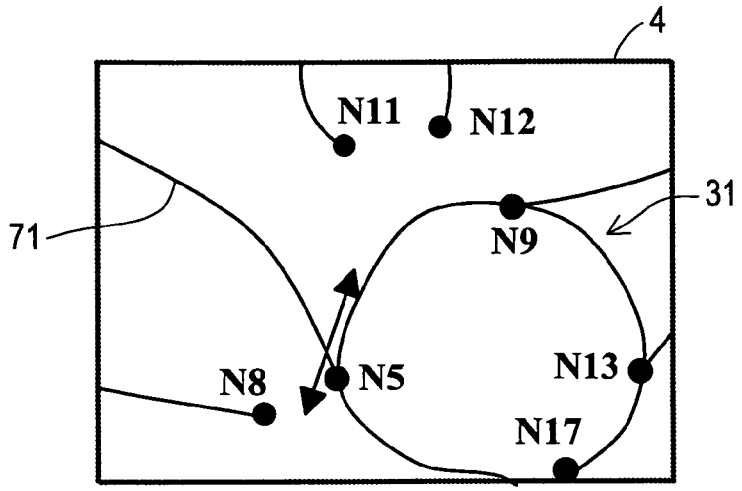
FIG. 23 is a diagram of an example of the display screen for inputting the dividing position by magnifying and displaying the dividing position of the line drawing.

As specifically described above, in the embroidery data processing device of exemplary embodiment 2, as shown in FIG. 23 and FIG. 24, when the user manipulates the mouse 6 and instructs to divide the line 71 of the line drawing 31 by the node N5, the line drawing 31 is divided by the node N5, into partial line drawings 73 and 75, and displayed on the CRT display 4. As shown in FIG. 25, the tree structure vector data 32 is divided by the node N5, into the partial tree structure vector data 77 deleting nodes N6 to N8, with the node N1 as the root node, and the partial tree structure vector data 78 composed of nodes N5 to N8, with the division node N5 as the root node. On the basis of the partial tree structure vector data 77 and 78, embroidery data 81 and 82 are created. Stitches of the embroidery pattern 85 sewn according to the embroidery data 81 form consecutive stitches corresponding to the partial line drawing 73. Stitches of the embroidery pattern 86 sewn according to the embroidery data 82 by changing thread colors form consecutive stitches corresponding to the partial line drawing 75, and thereby form stitches consecutive from the position corresponding to the node 6 of the embroidery pattern 85.

When the user manipulates the mouse 6, and instructs to divide the line 71 of the line drawing 31 by the node N5, the line drawing 31 is divided by the node N5, into partial line drawings 73 and 75, and displayed on the CRT display 4, so that the thread color changing position of the embroidery pattern 34 (see FIG. 6) can be easily recognized.

When the user manipulates the mouse 6, and instructs to divide the line 71 of the line drawing 31 by the node N5, nodes N6 to N8 are divided at the node 5 of the tree structure vector data 32, and partial tree structure vector data 77 and 78 can be created. On the basis of the partial tree structure vector data 77 and 78, embroidery data 81 and 82 in independent consecutive sewing sequence can be created, and beautiful and high-quality embroidery patterns 85 and 86 free from useless jump stitch in finished state can be formed, and the embroidery patterns 85 and 86 can be sewn by threads of desired colors according to embroidery data 81 and 82.

When the user manipulates the mouse 6, and instructs an arbitrary line of the line drawing 31 as the dividing position, the division node is added to the vector data corresponding to the dividing position of the tree structure vector data 32, and the user can set the dividing position on an arbitrary line of the line drawing 31, and the embroidery data can be formed by changing thread colors in desired area of the embroidery pattern 34.

The disclosure is not limited to exemplary embodiment 1 and exemplary embodiment 2, and may be modified within a scope not departing from the essential characteristics thereof. Other example is shown below. In the following explanation, same reference numerals as in the embroidery data processing device 1 in exemplary embodiment 1 and the embroidery data processing device in exemplary embodiment 2 shown in FIG. 1 to FIG. 28 refer to the same or corresponding parts or components.

Exemplary Embodiment 3

The single unit of the tree structure vector data is divided, and coupled again, and the position of the end node is changed, and the sewing sequence of the embroidery data created on the basis of the tree structure vector data is changed, and this tree structure vector data changing process is explained with reference to FIG. 29 and FIG. 30.

Figure 29:
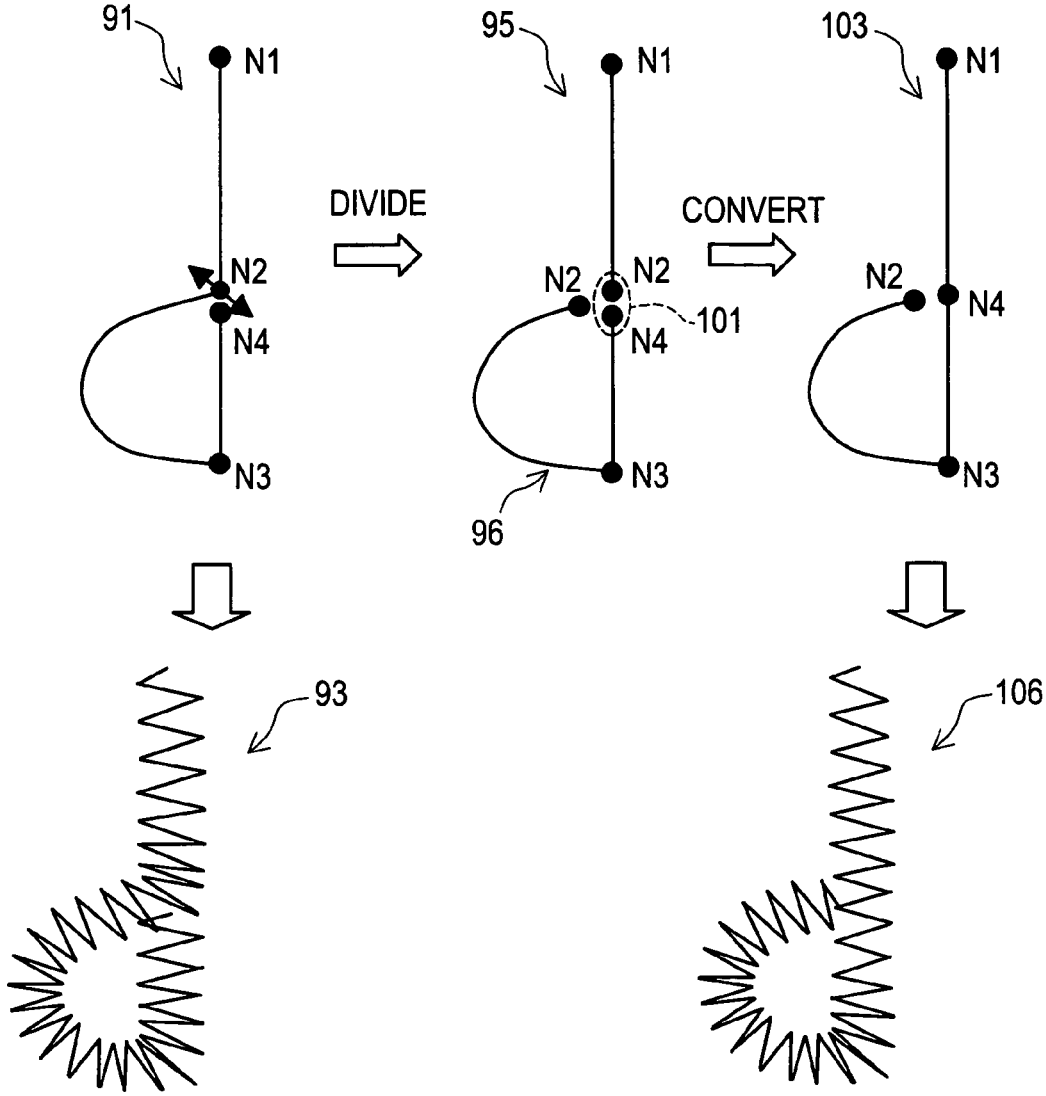
FIG. 29 shows other exemplary embodiment, in which the line drawing of the embroidery data processing device is divided, and coupled again, and the display state of each line drawing is shown at the upper side, and examples of the embroidery pattern corresponding to each line drawing before division and after coupling are shown at the lower side.
Figure 30:
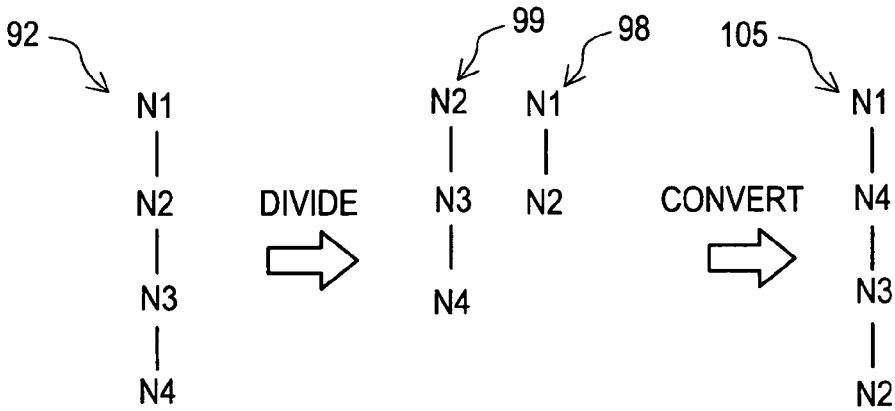
FIG. 30 is a diagram of an example of the tree structure vector data corresponding to the line drawing before division in FIG. 29, partial tree structure vector data corresponding to each partial line drawing after division, and the tree structure vector data corresponding to the line drawing after coupling.

As shown at the upper left end in FIG. 29, in the line drawing 91, the point N1 positioned at the highest end is set in the root node N1, and as shown at the left end in FIG. 30, the tree structure vector data 92 is formed from this root node N1 to nodes N2, N3, N4, and stored in tree structure vector memory area in the RAM 24. As shown at the lower left end in FIG. 29, the embroidery data is created on the basis of the tree structure vector data 92, and the sewn embroidery pattern 93 is suddenly bent in sewing direction at the position corresponding to the node N2 of the line drawing 91, and discontinuous stitches are formed from the node N3 to the node N4, and the appearance is impaired.

Accordingly, as shown at the upper left end in FIG. 29, when instructed to divide at the position of the node N2 of the line drawing 91 by manipulating the mouse 6, as shown in the upper center in FIG. 29, the CPU 22 divides the line drawing 91 by this node N2, and displays as partial line drawings 95 and 96. As a result, as shown in the center in FIG. 30, the CPU 22 divides the tree structure vector data 92 at the node N2, into the partial tree structure vector data 98 having the root node N1, and the partial tree structure vector data 99 having the division node N2 as the root node, and stores in the tree structure vector memory area.

In succession, as shown in the upper center in FIG. 29, by instructing a connecting position 101 for connecting the end node N2 of the partial line drawing 95 and the end node N4 of the partial line drawing 96 by manipulating the keyboard 5 or the mouse 6, as shown at the upper right end in FIG. 29, the CPU 22 overlays the end node N4 of the partial line drawing 96 on the end node N2 of the partial line drawing 95, and displays the line drawing 103 on the CRT display 4. Or as shown at the right end in FIG. 30, the CPU 22 couples the end node N4 of the partial tree structure vector data 99 to the end node N2 of the partial tree structure vector data 98 having the root node N1 so as to maintain the original root node N1, and converts the root node N2 of the partial tree structure vector data 99 into the end node N2, and creates the single unit of the tree structure vector data 105, and stores in the tree structure vector memory area. Further, as shown at the lower right end in FIG. 29, on the basis of this tree structure vector data 105, the embroidery data is created, and the sewn embroidery pattern 106 forms consecutive stitches at the position corresponding to the node N4 of the line drawing 103, and the embroidery pattern of good appearance is formed.

Therefore, the user manipulates the keyboard 5 or the mouse 6, divides the line drawing 91 shown on the CRT display 4 at the position of the node 2, couples the divided partial line drawings 95 and 96 together again at nearby end nodes N2 and N4, converts the end node of the tree structure vector data 92, and thereby creates the tree structure vector data 105, and therefore the sewing sequence of the sewing data of original consecutive stitches can be changed on the basis of the tree structure vector data 105, so that a beautiful and high-quality embroidery pattern 106 free from useless jump stitch in finished state can be formed.

While the presently exemplary embodiment of the disclosure has been shown and described, it is to be understood that this disclosure is for the purpose of illustration and that various changes and modifications may be made without departing from the scope of the invention as set forth in the appended claims.

What is claimed is:

1. An embroidery data processing device comprising:

a tree structure vector data creating device that creates tree structure vector data by coupling nodes mutually from a root node to an end node by vector data on the basis of drawing information composing an embroidery pattern;

an embroidery data creating device that creates running stitch sewing data on the basis of the vector data from the root node to the end node for the tree structure vector data, and creating embroidery stitch sewing data overlaid on the running stitch sewing data on the basis of the vector data from the end node to the root node;

a display control device that controls indication of a drawing in a display on the basis of the drawing information; and an input device that inputs a connecting position for coupling a first drawing and a second drawing separate from the first drawing, the first drawing and the second drawing being indicated in the display and corresponding to first tree structure vector data and second tree structure vector data, respectively;

wherein the display control device indicates a predetermined shaped connecting region around the connecting position, when the connecting position is inputted by the input device, and wherein the tree structure vector data creating device includes:

a first node detecting device that detects a first node of the first tree structure vector data existing within the connecting region;

a second node detecting device that detects a second node of the second tree structure vector data existing within the connecting region; and a coupled tree structure vector data creating device that creates a single unit of tree structure vector data by coupling the second node to the first node when both the first node and the second node existing within the connecting region are detected.

2. The embroidery data processing device according to claim 1, wherein the coupled tree structure vector data creating device includes:

a first coupling node adding device that adds a first coupling node on the vector data of the first tree structure vector data existing within the connecting region when the first node existing within the connecting region is not detected, and the coupled tree structure vector data creating device creates the single unit of the tree structure vector data by coupling the first coupling node added by the first coupling node adding device to the second node existing within the connecting region.

3. The embroidery data processing device according to claim 2, wherein the first coupling node adding device adds the first coupling node on one of the other first tree structure vector data existing within the connecting region and vector data closest to the second tree structure vector data.

4. The embroidery data processing device according to claim 2, wherein the coupled tree structure vector data creating device includes:

a second coupling node adding device that adds a second coupling node on the vector data of the second tree structure vector data existing within the connecting region when the second node existing at the connecting position is not detected, and the coupled tree structure vector data creating device creates the single unit of the tree structure vector data by coupling the second coupling node added by the second coupling node adding device to one of the first node and the first coupling node existing within the connecting region.

5. The embroidery data processing device according to claim 4, wherein the first coupling node adding device and the second coupling node adding device add the first coupling node and the second coupling node to one of the other first tree structure vector data existing within the connecting region and the vector data closest to the second tree structure vector data.

6. The embroidery data processing device according to claim 1, further comprising:

a tree structure vector data selecting device that selects one of the first tree structure vector data and the second tree structure vector data as the tree structure vector data for maintaining the root node; and a tree structure vector data converting device that converts a node mutual direction so that the node to be coupled may be the root node for the other tree structure vector data without the root node, unselected by the tree structure vector data selecting device, wherein the coupled tree structure vector data creating device couples the one tree structure vector data selected by the tree structure vector data selecting device to the other tree structure vector data converted by the tree structure vector data converting device, by the node to be coupled, and creates the single unit of the tree structure vector data having the root node contained on the one tree structure vector data as the root node.

7. An embroidery data processing device comprising:

a tree structure vector data creating device that creates tree structure vector data by coupling nodes mutually from a root node to an end node by vector data on the basis of drawing information composing an embroidery pattern;

the embroidery data creating device that creates running stitch sewing data on the basis of the vector data from the root node to the end node for the tree structure vector data, and creating embroidery stitch sewing data overlaid on the running stitch sewing data on the basis of the vector data from the end node to the root node;

a dividing position input device that inputs a dividing position for dividing the tree structure vector data into plural pieces of partial tree structure vector data; and a tree structure vector data dividing device that divides the tree structure vector data into the plural pieces of the partial tree structure vector data on the basis of the dividing position input by the dividing position input device.

8. The embroidery data processing device according to claim 7, further comprising:

a node detecting device that detects whether the node of the tree structure vector data is present or not at the dividing position input by the dividing position input device, wherein the tree structure vector data dividing device divides the tree structure vector data into the plural pieces of the partial tree structure vector data, by the detected node, when the node existing at the dividing position is detected.

9. The embroidery data processing device according to claim 7, further comprising:

a node detecting device that detects whether the node of the tree structure vector data is present or not at the dividing position input by the dividing position input device, wherein the tree structure vector data dividing device includes:

a division node adding device that adds a division node on the vector data existing at the dividing position when node existing at the dividing position is not detected, and the tree structure vector data dividing device divides the tree structure vector data into the plural pieces of the partial tree structure vector data by the division node added by the division node adding device.

10. The embroidery data processing device according to claim 7, further comprising:

a root node converting device that converts one of the node and the division node existing at the dividing position, into the root node, in the partial tree structure vector data without the root node in the tree structure vector data before division, out of the plural pieces of the partial tree structure vector data divided by the tree structure vector data dividing device, wherein the embroidery data creating device creates the running stitch sewing data and the embroidery stitch sewing data on the basis of the root node converted by the root node converting device.

11. A computer-readable storage medium that stores a computer-executable program for an embroidery data processing device, the program causes a computer to perform steps of:

a tree structure vector data creating step of creating tree structure vector data by coupling nodes mutually from a root node to an end node by vector data on the basis of drawing information composing an embroidery pattern;

an embroidery data creating step of creating running stitch sewing data on the basis of the vector data from the root node to the end node for the tree structure vector data, and creating embroidery stitch sewing data overlaid on the running stitch sewing data on the basis of the vector data from the end node to the root node;

a display control step of controlling indication of a drawing in a display on the basis of the drawing information;

a connecting position obtaining step of obtaining a connecting position for coupling a first drawing and a second drawing separate from the first drawing indicated in the display when the connecting position is inputted, the first drawing and the second drawing corresponding to first tree structure vector data and second tree structure vector data, respectively;

a connecting region indicating step of indicating a predetermined shaped connecting region around the connecting position obtained at the connecting position obtaining step;

a first node detecting step of detecting a first node of the first tree structure vector data existing within the connecting region indicated at the connecting region indicating step; and a second node detecting step of detecting a second node of the second tree structure vector data existing with the connecting region indicated at the connecting region indicating step, wherein the tree structure vector data creating step includes:

a coupled tree structure vector data creating step of creating a single unit of tree structure vector data by coupling the second node to the first node when both the first node and the second node existing within the connecting region are detected.

12. The computer-readable storage medium according to claim 11, wherein the coupled tree structure vector data creating step includes:

a first coupling node adding step of adding a first coupling node on the vector data of the first tree structure vector data existing within the connecting region when the first node existing at the connecting position is not detected; and the coupled tree structure vector data creating step creates the single unit of the tree structure vector data by coupling the first coupling node added at the first coupling node adding step to the second node existing within the connecting region.

13. The computer-readable storage medium according to claim 12, wherein the first coupling node adding step adds the first coupling node on one of the other first tree structure vector data existing within the connecting region and vector data closest to the second tree structure vector data.

14. The compute-readable storage medium according to claim 12, wherein the coupled tree structure vector data creating step includes:

a second coupling node adding step of adding a second node on the vector data of the second tree structure vector data existing within the connecting region, when the second node existing at the connecting position is not detected, and the coupled tree structure vector data creating step creates the single unit of the tree structure vector data by coupling the second coupling node added at the second coupling node adding step to one of the first node and the first coupling node existing within the connecting region.

15. The computer-readable storage medium according to claim 14, wherein the first coupling node adding step and the second coupling node adding step add the first coupling node and the second coupling node to one of the other first tree structure vector data existing within the connection region and the vector data closest to the second tree structure vector data.

16. The computer-readable storage medium according to claim 11, the program further causes the computer to perform the steps of:

a tree structure vector data selecting step of selecting one of the first tree structure vector data and the second tree structure vector data as the tree structure vector data for maintaining the root node; and a tree structure vector data converting step of converting a node mutual direction so that the node to be coupled may be the root node for the other tree structure vector data without the root node, unselected at the tree structure vector data selecting step, wherein the coupled tree structure vector data creating step couples the one tree structure vector data selected at the tree structure vector data selecting step to the other tree structure vector data converted at the tree structure vector data converting step, by the node to be coupled, and creates the single unit of the tree structure vector data having the root node contained on the one tree structure vector data as the root node.

17. A computer-readable storage medium that stores a computer-executable program for an embroidery data processing device, the program causes a computer to perform steps of:

a tree structure vector data creating step of creating tree structure vector data by coupling nodes mutually from a root node to an end node by vector data on the basis of drawing information composing an embroidery pattern;

an embroidery data creating step of creating running stitch sewing data on the basis of the vector data from the root node to the end node for the tree structure vector data, and creating embroidery stitch sewing data overlaid on the running stitch sewing data on the basis of the vector data from the end node to the root node;

a dividing position input step of inputting a dividing position for dividing the tree structure vector data into a plural pieces of partial tree structure vector data; and a tree structure vector data dividing step of dividing the tree structure vector data into the plural pieces of the partial tree structure vector data on the basis of the dividing position input at the dividing position input step.

18. The computer-readable storage medium according to claim 17, the program further causes the computer to perform the step of:

a node detecting step of detecting whether the node of the tree structure vector data is present or not at the dividing position input at the dividing position input step, wherein the tree structure vector data dividing step divides the tree structure vector data into the plural pieces of the partial tree structure vector data, by the detected node, when the node existing at the dividing position is detected.

19. The computer-readable storage medium according to claim 17, the program further causes the computer to perform the step of:

a node detecting step of detecting whether the node of the tree structure vector data is present or not at the dividing position input at the dividing position input step, wherein the tree structure vector data dividing step includes:

a division node adding step of adding a division node on the vector data existing at the dividing position when the node existing at the dividing position is not detected, and the tree structure vector data dividing step divides the tree structure vector data into the plural pieces of the partial tree structure vector data by the division node added at the division node adding step.

20. The computer-readable storage medium according to claim 17, the program further causes the computer to perform the step of:

a root node converting step of converting one of the node and the division node existing at the dividing position, into the root node, in the partial tree structure vector data without the root node in the tree structure vector data before division, out of the plural pieces of the partial tree structure vector data divided at the tree structure vector data dividing step, wherein the embroidery data creating step creates the running stitch sewing data and the embroidery stitch sewing data on the basis of the root node converted at the root node converting step.

* * * * *